US009828742B2

(12) United States Patent
Hagenbuch

(10) Patent No.: US 9,828,742 B2
(45) Date of Patent: Nov. 28, 2017

(54) CUTTER ASSEMBLY WITH FREEWHEELING CUTTING ELEMENTS

(71) Applicant: LeRoy G. Hagenbuch, Peoria Heights, IL (US)

(72) Inventor: LeRoy G. Hagenbuch, Peoria Heights, IL (US)

( * ) Notice: Subject to any disclaimer, the term of this patent is extended or adjusted under 35 U.S.C. 154(b) by 0 days.

(21) Appl. No.: 14/611,161

(22) Filed: Jan. 30, 2015

(65) Prior Publication Data

US 2015/0218776 A1 Aug. 6, 2015

Related U.S. Application Data

(60) Provisional application No. 61/934,476, filed on Jan. 31, 2014, provisional application No. 61/947,749, filed on Mar. 4, 2014, provisional application No. 62/010,171, filed on Jun. 10, 2014.

(51) Int. Cl.

| | |
|---|---|
| ***E02F 5/06*** | (2006.01) |
| ***E02F 3/08*** | (2006.01) |
| ***E02F 3/10*** | (2006.01) |
| ***E02F 3/14*** | (2006.01) |
| ***E02F 9/28*** | (2006.01) |
| ***E21C 25/00*** | (2006.01) |

(52) U.S. Cl.

CPC ..... *E02F 5/06* (2013.01); *E02F 3/086* (2013.01); *E02F 3/088* (2013.01); *E02F 3/10* (2013.01); *E02F 3/142* (2013.01); *E02F 9/2858* (2013.01); *E02F 9/2866* (2013.01); *E21C 25/00* (2013.01)

(58) Field of Classification Search

CPC . E02F 3/142; E02F 9/28; E02F 9/2866; E02F 9/2858; E02F 3/086; E02F 3/088; E02F 3/10; E02F 5/06; E21B 10/08; E21B 11/06; E21C 25/06; E21C 25/16; E21C 25/20; E21C 25/22; E21C 25/28; E21C 25/34; E21C 25/40; E21C 25/56; E21C 35/18; E21C 25/00

See application file for complete search history.

(56) References Cited

U.S. PATENT DOCUMENTS

| | | | |
|---|---|---|---|
| 568,933 | A | 10/1896 | Wiles |
| 588,051 | A | 8/1897 | Bliss |
| 845,837 | A | 3/1907 | Wines |
| 908,517 | A | 1/1909 | Sturtevant |
| 982,038 | A | 1/1911 | Curry |
| 1,185,504 | A | 5/1916 | Hemenway |
| 1,202,908 | A | 10/1916 | Slauson et al. |
| 1,203,109 | A | 10/1916 | Gitzendanner |
| 1,236,445 | A | 8/1917 | Kast |

(Continued)

OTHER PUBLICATIONS

International Search Report and Written Opinion for co-pending International Application No. PCT/US2015/13997 dated Apr. 23, 2015.

(Continued)

*Primary Examiner* — Jamie L McGowan

(74) *Attorney, Agent, or Firm* — Leydig, Voit & Mayer, Ltd.

(57) ABSTRACT

A universal cutter assembly comprising a transport device carrying a plurality of freewheeling cutting elements mounted to freely rotate about an axis, where the axis is canted about two angles with respect to the surface being cut and a line of action imparted by the transport device.

21 Claims, 19 Drawing Sheets

(56) References Cited

U.S. PATENT DOCUMENTS 1,236,909 A 8/1917 Christensen
1,257,482 A 2/1918 Davidson et al.
1,294,559 A 2/1919 Sproul
1,404,835 A * 1/1922 Christine ..... E21C 25/34 144/123
1,449,697 A 3/1923 Richards
1,550,669 A 4/1925 Bowman
1,555,218 A 9/1925 Kennedy
1,582,332 A 4/1926 Brutus
1,586,196 A 5/1926 Halvorsen
1,618,591 A 2/1927 Jacobsen
1,651,122 A 11/1927 Hoffert
1,658,397 A 2/1928 Schmidt
1,765,602 A 6/1930 McKinlay
1,845,412 A 2/1932 Hathaway
1,883,307 A 10/1932 Livingston et al.
1,903,772 A 4/1933 Bowman
2,025,527 A 12/1935 Schramm
2,096,875 A 10/1937 Bertovich
2,149,462 A 3/1939 Oppliger
2,163,732 A 6/1939 Kleineberg et al.
2,210,919 A 8/1940 Joy
2,310,289 A 2/1943 Hokanson
2,325,455 A 7/1943 Williams
RE22,359 E 8/1943 Christensen
2,336,335 A 12/1943 Zublin
2,363,969 A 11/1944 Jones
2,550,202 A 4/1951 Robbins
2,634,971 A 4/1953 Schweizer
2,650,812 A 9/1953 Joy
2,650,813 A 9/1953 Rollins et al.
2,659,586 A 11/1953 Leven
2,676,005 A 4/1954 Joy
2,693,356 A 11/1954 Hofferth
2,698,174 A 12/1954 Deuel et al.
2,709,584 A 5/1955 Kleinberg
2,720,717 A * 10/1955 Arps ..... E02F 3/10 299/83.1
2,736,999 A 3/1956 Rouan et al.
2,737,378 A 3/1956 Barrett
2,742,281 A 4/1956 Whitecar
2,742,439 A 4/1956 Hallett
2,796,255 A 6/1957 Mitchell
2,798,712 A 7/1957 Ball
2,810,567 A * 10/1957 Kirkham ..... E21C 25/34 175/374
2,856,182 A 10/1958 Cantrell
2,867,427 A 1/1959 Russell et al.
2,873,112 A 2/1959 Crafts et al.
2,926,896 A 3/1960 Krekeler
2,935,308 A 5/1960 Zorn
2,939,692 A 6/1960 Russell et al.
2,966,354 A 12/1960 Gore
3,039,208 A 6/1962 Oglesby et al.
3,059,391 A 10/1962 Volks et al.
3,061,291 A 10/1962 Jones
3,140,898 A 7/1964 Rogers
3,176,778 A 4/1965 Bezzerides
RE25,806 E 6/1965 Oglesby et al.
3,295,232 A 1/1967 Oglesby et al.
3,299,232 A 1/1967 Oglesby et al.
3,361,481 A 1/1968 Maddock
3,397,012 A 8/1968 Krekeler
3,397,013 A 8/1968 Krekeler
3,471,950 A 10/1969 Ferwerda
3,493,268 A 2/1970 Bower, Jr.
3,498,677 A 3/1970 Morrow
3,512,838 A 5/1970 Kniff
3,519,309 A 7/1970 Engle et al.
3,554,605 A 1/1971 Elders
3,627,381 A 12/1971 Krekeler
3,650,565 A 3/1972 Kniff
3,652,130 A 3/1972 Elders
3,658,318 A 4/1972 Bunting et al.
3,663,007 A 5/1972 Preiter
3,663,063 A * 5/1972 Johnmeyer, Sr. ..... E02F 9/2866 299/107
3,679,265 A 7/1972 Krekeler
3,695,726 A 10/1972 Krekeler
3,697,137 A 10/1972 Krekeler
RE27,686 E 6/1973 Kniff
3,746,396 A 7/1973 Radd
3,749,449 A 7/1973 Krekeler
3,752,534 A 8/1973 Rollins et al.
3,767,266 A 10/1973 Krekeler
3,778,112 A 12/1973 Krekeler
3,784,259 A 1/1974 Munger et al.
3,787,091 A 1/1974 Paolini et al.
3,796,464 A 3/1974 Hansen et al.
3,801,158 A 4/1974 Radd et al.
3,807,803 A 4/1974 Rollins et al.
3,820,848 A 6/1974 Kniff
3,833,264 A 9/1974 Elders
3,833,265 A 9/1974 Elders
3,841,707 A * 10/1974 Kniff ..... E21C 35/18 299/84.1
RE28,310 E 1/1975 Krekeler
3,865,437 A 2/1975 Crosby
3,888,133 A 6/1975 Krekeler
3,913,979 A 10/1975 Strauss et al.
3,926,423 A 12/1975 Merker et al.
3,945,681 A 3/1976 White
3,954,301 A 5/1976 Stepp
3,957,307 A 5/1976 Varda
3,968,995 A 7/1976 Arentzen
3,979,843 A 9/1976 Nissen
3,988,016 A 10/1976 Merker et al.
3,992,061 A 11/1976 Rollins
4,244,625 A * 1/1981 Turner ..... E21C 35/18 299/83.1
4,448,269 A * 5/1984 Ishikawa ..... E21B 10/14 175/335
5,338,102 A * 8/1994 Lent ..... E02F 9/02 299/10
7,950,170 B2 5/2011 Hall et al.
2008/0163523 A1* 7/2008 Seidl ..... E02F 9/2866 37/352
2008/0282584 A1* 11/2008 Hall ..... E02F 3/142 37/352
2010/0107455 A1* 5/2010 Hall ..... E02F 3/10 37/352

OTHER PUBLICATIONS

Table 2-1, Draft and Power Requirement of Crop Machine, from *Crop-Production Equipment*, p. 20, Mar. 17, 1977.
"Disk Tools", Chapter 13 from *Crop-Production Equipment*, pp. 138-147, Mar. 17, 1977.
"Disk Implements", Chapter 7 from *Principles of Farm Equipment*, pp. 153-168.
Article entitled: "More Miles of tunnel. More Miles of Shafts and Raises. More than 300 Machines Worldwide" from *Robbins Company*, Jan. 1981 (p. 82).
Article entitled "*Chicago's Grand Plan Imperiled*" ENR/Dec. 17, 1981, p. 33.
Article entitled: "When Rock Talks, We Listen" *from Timken Company*, p. 116, Jan. 1981.
Article entitled:"Ripperveyor Cutter Head Gives Higher Production, Better Clean-Up" from *Joy Manufacturing Company*, inventor first became aware of this in early 1981.
Article entitled "Depend on McNally Repairs to Minimize Equipment Replacement", *Mc Nally Mountain States Steel Co.*, p. 17, Jul. 1981.
Article entitled "Take another look at our—There's more than meets the eye—hidden benefits such a proven new approaches to productivity—significant reliability and safety benefits", *Jeffrey Mining Machinery Division Dresser Industries, Inc.*, inventor first became aware of this in early 1981.
Article entitled "*Kennametal Tools for Road Planning*", pp. 10, 11, and 13-15, inventor first became aware of this in early 1981.

(56) References Cited

OTHER PUBLICATIONS

Roto-Mill PR-750 Pavement Profiler, Features and Specifications, inventor first became aware of this in early 1981.
Pengo Corporation—Interchangeable Teeth, *Bulletin* 114, 1977.
Article entitled "Straight Creek Miners Discover 6,354 Extra Fee on a Hughes HH44", *Huges Toll Company*, inventor first became aware of this in early 1981.
Austin Drill Heads, Speed Auger and Air Drilling, *Austin Power Company*, LL-9724, inventor first became aware of this in early 1981.
H&L Tooth Company, Litho, US, *Brochure HL-227A* (pp. 7, 9, 13 & 15), inventor first became aware of this in early 1981.
Pengo Augers, For use on all makes of boring machines, for use on all types of boring machines, fast digging in all kinds of material, Designed fro Strength and durability, *Bulletin* 92A, 1978.
*Hensley Ripping Attachments*, inventor first became aware of this in early 1981.
Wain Roy, *Ripper Bucket, Excavate caliches, coral, frost, limestone, sandstone and shale* (1 page), inventor first became aware of this in early 1981.
*Information Cones with Carbide button Tips* (2 pages), inventor first became aware of this in early 1981.
*ESCO, Ground Engagement Tools* (1 page), inventor first became aware of this in early 1981.
*Tradeshow Pictures* (1 page), inventor first became aware of this in early 1981.
Alpine Cutters, "Rock & Concrete Cutter", *MCS Magazine* (Modern Contractor Solutions), Oct. 2013 (1 page).
Altcut Products, "*Flat Face Carbide Cutters*", retrieved from http:www.altcutproducts.com/item.php?pageid=ffctfail&units on Jan. 30, 2009, (1 page).
Grayson, Wayne, "Baby Bertha? Bechtel builds mimi tunnel-boring machine using 50,000 Legos", *Construction News*, retrieved from http:www.equipmentworld.com/video-baby-bertha-bechtel-builds-mini-tunnel-boring-ma . . . on Feb. 10, 2014 (1 page).
Grayson, Wayne, "Big Bertha, world's largest tunnel-boring machine arrives in Seattle", on Apr. 4, 2013, *Construction News* retrieved from http:www.equipmentworld.com/bi-bertha-worlds-largest-tunnel-boring-machine-arrives . . . (Feb. 10, 2014) (3 pages).
CONEQTEC Universal—"*Call you dealer to fine out about new reduced prices", Slot Cutters*, retrieved from http:www.coneqtecuniversal.com/slotcutter.html on Jan. 30, 2009, (10 pages).
Duratooth Combos110K Chains, *Ditch Systems Parts Catalog*, 2013 (3 pages).
Kirian, Denny, "*DK-628 Chain Trencher*", Done Right, inventor first became aware of this article in 2000. (3 pages).
"Introducing the New SL 900", A Winning Combination: High Productivity, High Availability and EiControl Automation, 2 page from *Coal Age Magazine*, Apr. 2011.
Jeffrey Machine, Inc., "Drilling Tools Field Guide", pp. 5-9, 30, 36-42, 46 and 52-53, © 2011-2012, *Jeffrey Machine Inc.* (18 pages).
Marais Groupe, SMC 200 R Wheel Trencher for the mechanical laying of networks, *Product Brochure*, Feb. 2006, (10 pages).
Mastenbroek Technologie Novatrice, *Product Brochure*, HRT, 2006 (4 pages).
Mastenbroek, *Rock Trenchers*, Mastenbroek rock trenchers combine innovative and robust design together with quality components and the versatility afforded by a variety of installation systems, Apr. 2014 (6 pages).
Port Industries, Hydramaxx 2500, 2600 and 2400, *Product Brochure*, Jan. 1, 2007 (6 pages).
Rivard *Product Brochure* for "RIV 503 TR 250 Rock Saw Wheel Trencher", 2009, (4 pages).
Rivard *Product Brochure* for Trancheuse 500 CH and RIV 523 TR 250, Wheel Trenchers, 2009 (4 pages).
Smith Manufacturing website information, retrieved from http://www.smithmfg.com on Jan. 30, 2009 (2 pages).
TESMEC, USA, Inc., 775DT "Dirt Series", *Product Brochure*, Aug. 1, 2013, (2 pages).
Roepke, Wallace W., et al., "Bureau of Mines Coal Cutting Technology Facilities at the Twin Cities Research Center", *Bureau of Mines Information Circular*/1983, Information Circular 8951 (31 pages).
United States Department of the Interior Bureau of Mines, *Mounting Post Drawing*, Feb. 25, 1988, (1 page).
Vermeer , T1655 Terrain Leveler ® *Surface Excavation Machine*, © 2012, (6 pages).
Vermeer, "Our Newest High Performance Machine, This is Where the Name of the Machine Matters Most", pages from *International Mining Magazine*, May 2011, (2 pages).
Vermeer Risa Trancheuses Et *Equipment Brochure*, © 2001, (3 pages).
Vermeer Utility Tracker, RTX 1250 Product Brochure, © 2009, (6 pages).
International Preliminary Report on Patentability for co-pending International Application No. PCT/US2015/13997 dated Aug. 11, 2016.
Disc Blades, Disc Harrow Blades, Notched and Plain, retrieved from Home/Grizzly® Brand, Agri Supply—Shop—Home, retrieved (http://www.agrisupply.com/grizzly/c/8000005), (2016), (7 pages).
Kepner, R.A., et al., Principles of Farm Machinery, Second Edition, "Disk Implements", Chapter 7, *The AVI Publishing Company, Inc.*, 1972, (pp. 153-160).
Richey, C.B., et al., *Agricultural Engineers Handbook*, "Disk Tools", Chapter 13, McGraw-Hill Book Company, Inc., 1981, (11 pages).
"Disc Harrow Requirements", Equipment How-to, *Small Farmers Journal*, (6 pages), originally appeared in Small Farmers Journal, Issue 28-3 (2016).
Article entitled "Earth Materials", from Wikipedia, the free encyclopedia, retrieved from https://en.wikipedia.org/wiki/Earth_materials#Definitions, Sep. 19, 2016.

* cited by examiner

CUTTER ASSEMBLY WITH FREEWHEELING CUTTING ELEMENTS

CROSS REFERENCE TO RELATED APPLICATIONS

This patent application claims the benefit of U.S. Provisional Application No. 61/934,476, filed Jan. 31, 2014, U.S. Provisional Application No. 61/947,749, filed Mar. 4, 2014, and U.S. Provisional Application No. 62/010,171, filed Jun. 10, 2014.

FIELD

The present invention generally relates to cutter assemblies and, more particularly, to cutter assemblies which are useful in trencher machines, boring machines, and profiling machines and similar cutting or abrading rock and earthen apparatuses.

BACKGROUND

One of the difficulties with present cutter assemblies, used in trenchers, is that the cutting elements are generally not suitable for trenching through both hard materials and soft materials without changing the cutting elements. Furthermore, the cutting elements are generally not capable of penetrating certain extremely hard materials, such as reinforced concrete, rocks, tree stumps, frozen earth and certain kinds of land fill, or at best penetrate such materials only very slowly and/or with a high rate of wear. Consequently, cutting through extremely hard materials is an extremely costly undertaking today, and in many cases is simply not feasible.

SUMMARY

In accordance with the present invention, there is provided a universal cutter assembly for use in trenches on road profilers and the like, comprising a transport device carrying a plurality of free-wheeling rotatable cutting elements that have a cutting edge at an outer periphery thereof and a cutting face on at least one side thereof. At least a portion of the cutting elements are canted such that the cutting face is at an angle to the line of action of the cutting element, which is imparted by the transport device.

Other aspects and advantages of the invention will be apparent from the following detailed description and the accompanying drawings.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

An aspect of the present invention is to provide an improved cutter assembly which is universal in the sense that it can include various types of transport devices such as linear, circular and the like that carry the cutting elements and in the sense that it is capable of cutting through extremely hard materials as well as soft materials, such as sandy loamy soil, without the need to frequently change the cutting elements.

Embodiments of the invention provide an improved cutter assembly which is capable of cutting through extremely hard materials with a high degree of cutting efficiency and, therefore, at relatively fast cutting rates, e.g., at rates of up to six to twelve inches per minute or greater through reinforced high-strength concrete of various thickness. In this connection, an aspect of the invention is to provide such a cutting assembly which produces a unique cutting action that fractures the material being cut by subjecting the material primarily to tensile forces rather than compressive forces.

In an embodiment, the invention provides a cutter assembly, in which the cutting elements have a relatively long operating life, thereby minimizing the down time for periodic replacement of the cutting elements and reducing replacement costs.

Turning now to the drawings, FIGS. 1-29 which illustrate embodiments of a cutter assembly that is part of a trencher, where the cutting elements are mounted on a chain that operates as the transport device of the cutter assembly. The embodiments suitably describe many aspects and advantages of the operation of a cutter assembly that utilizes the present invention. However, the cutter assembly of the present invention is certainly not limited to trenching. Other exemplary embodiments of cutter assemblies in accordance with the present invention are described in more detail below following the description of FIGS. 1-29.

Figure 1:
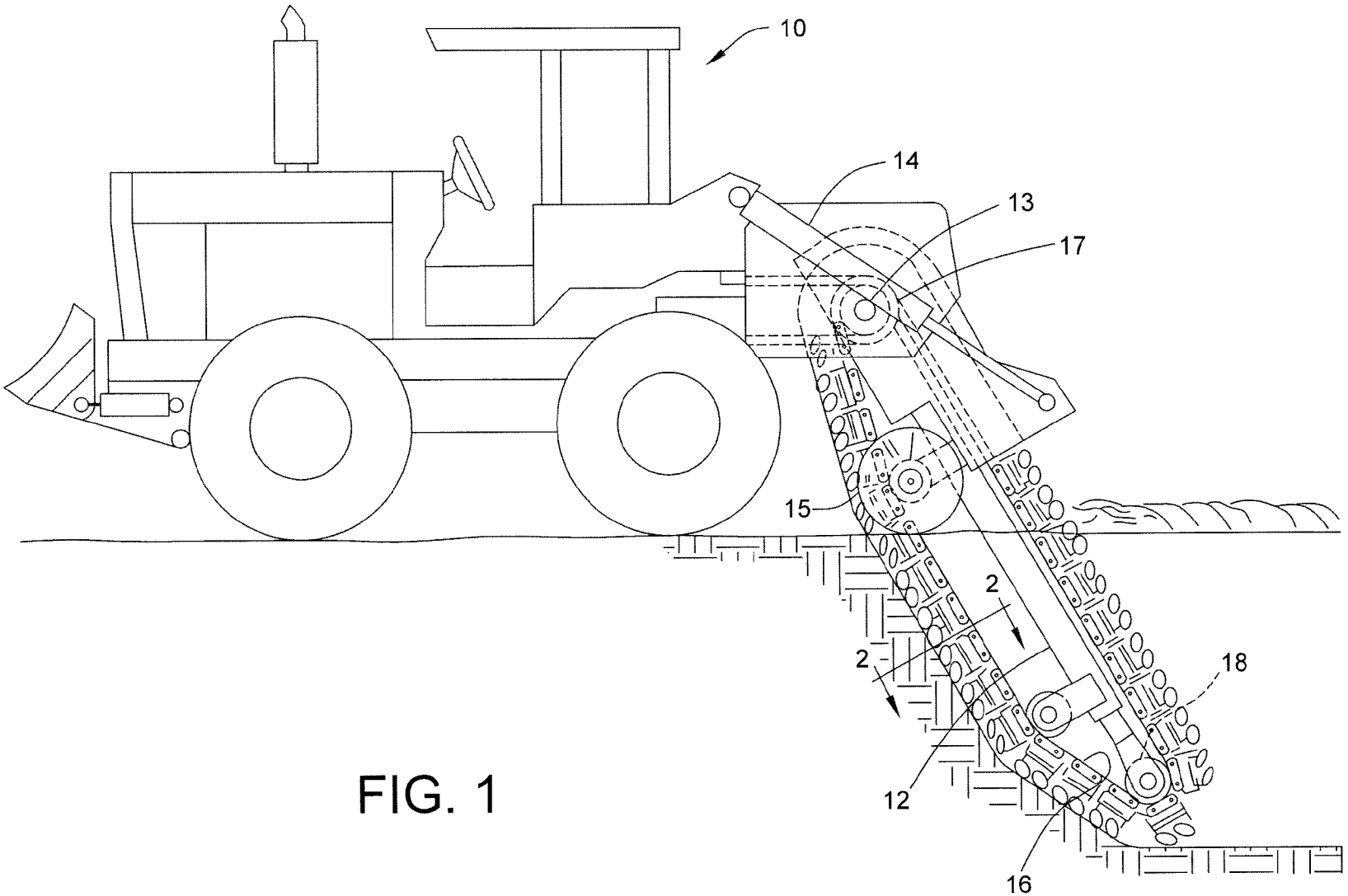
FIG. 1 is a side elevation of a trencher machine utilizing a cutter assembly in accordance with one embodiment of the present invention.

Referring first to FIG. 1, there is shown a trencher machine 10. The trencher includes a boom 12 pivoted on a shaft 13 so that the trencher boom can be raised and lowered by means of a hydraulic cylinder 14. As material excavated by the trencher is brought to the surface, it is moved laterally by means of an auger 15 and deposited along one or both sides of the trench. Alternatively, the material brought to the surface could be moved laterally by other devices, such as a conveyor. The trenching machine can include a conventional boom, as shown in FIG. 1, or it can include a boom with a frost bar and is some cases a rock saw wheel to provide support for the cutting elements when cutting through harder materials.

In the particular embodiment illustrated, the cutting elements of the trencher are carried by an endless chain trained about a driven sprocket 17 at the upper end of the boom 12, and an idler sprocket 18 at the lower end of the boom. The chain 16, which is driven in the clockwise direction as viewed in FIG. 1, serves as the driven transport device or carrier for the cutting elements. Each link 19 of the chain 16 is equipped with mounting plates 20 (see FIGS. 2A and 2B) which are connected to a carrier plate 22 by a bolted connection 23.

Figure 3:
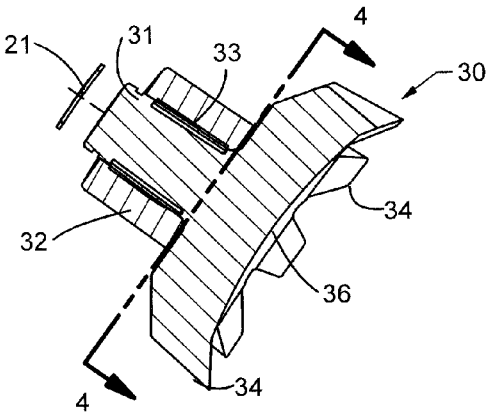
FIG. 3 is a section taken generally along line 3-3 in FIG. 2B.

Mounted on the outer surface of each carrier plate 22 is a cluster of freewheeling cutting elements 30. As can be seen in FIG. 3, each of these cutting elements 30 has a shaft 31 projecting from one side thereof to journal the cutting element in a freewheeling manner in a mount 32 attached to the carrier plate 22. Alternatively, the shaft could be fixed in place and the cutting elements could include a bore that receives the fixed shaft in a freewheeling connection. The term freewheeling, as used herein, describes the connection of the cutting elements to a corresponding mount on the transport device of the cutting assembly, which in this case is the carrier plate 22 attached to the chain 16. Specifically, this connection is referred to as freewheeling in that the components or machinery of the cutting assembly does not directly impart or inhibit any rotational motion of the cutting elements with respect to the mount. Instead, in the freewheeling connection of the cutting elements, any rotation of the cutting elements only occurs as a result of a relative motion between the transport device (carrier plate 22) and an external earthen material that is in contact with the cutting element, such as the surface being cut.

In an illustrated embodiment, the freewheeling connection of the cutting element with the mount is provided by a shaft that is integral with the cutting element 30 as a single monolithic piece held in the mount 32. Likewise, the mount 32 is securely attached to the carrier plate 22 in order to maintain a strong connection of the cutting elements to the chain 16. To hold the cutting elements in place, the shaft 31 can extend all the way through a hole formed in the mount 32 and be held captive therein by means of a snap ring 21 or other device. The wheel end of the hole in the mount 32 can be slightly flared, as shown in FIG. 3, to accommodate the radius in the corner where the rear surface of the cutting element 30 merges with the shaft 31. The bearing surface for the shaft 31 of the cutting assembly can be formed by the cylindrical wall of the hole in the mount 32. Thus, the entire load imposed on the cutting element 30 during a cutting operation is borne by the mount 32, and eventually by the carrier plate 22, the mounting plates 20 and the chain assembly. One particular alloy steel that could be used to produce the mounts 32 would be steel with about 11 to 15 percent manganese and 0.7 to 1.4 percent carbon. Such a steel alloy is sometimes referred to as Hadfield manganese steel.

Figure 5A:
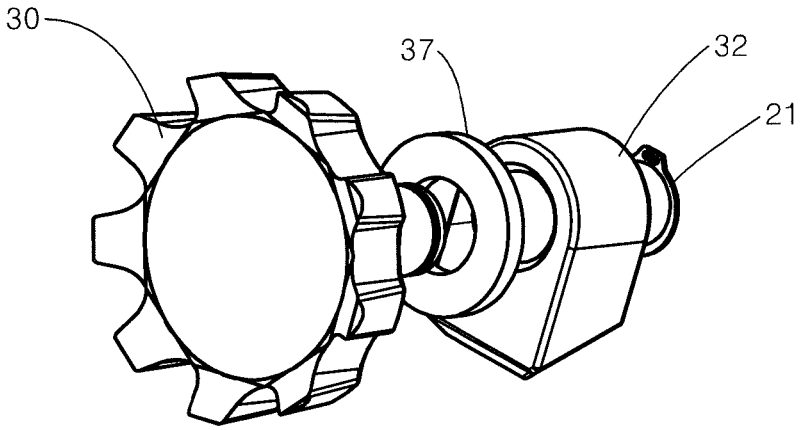
FIG. 5A is an exploded perspective view of an alternative embodiment for mounting the free-wheeling cutting elements.
Figure 5B:
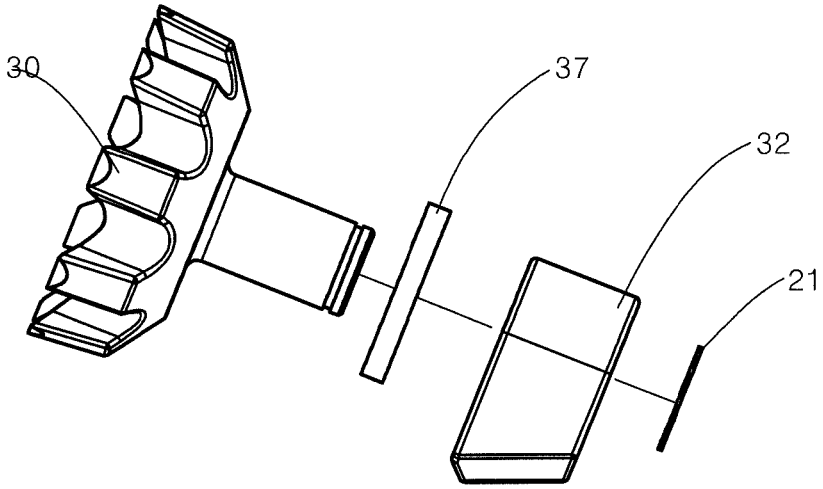
FIG. 5B is a side view of the free-wheeling cutting element in FIG. 5B.
Figure 6:
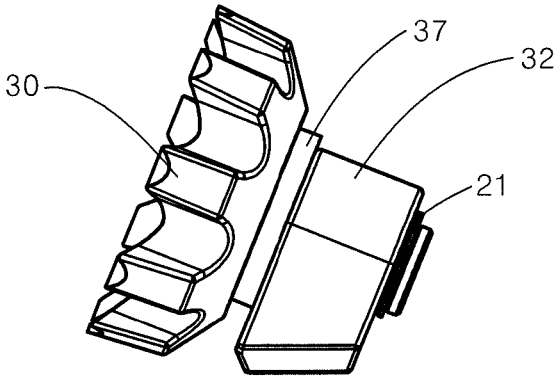
FIG. 6 is an assembled, side view of the free-wheeling cutting element of FIGS. 5A and 5B.
Figure 7:
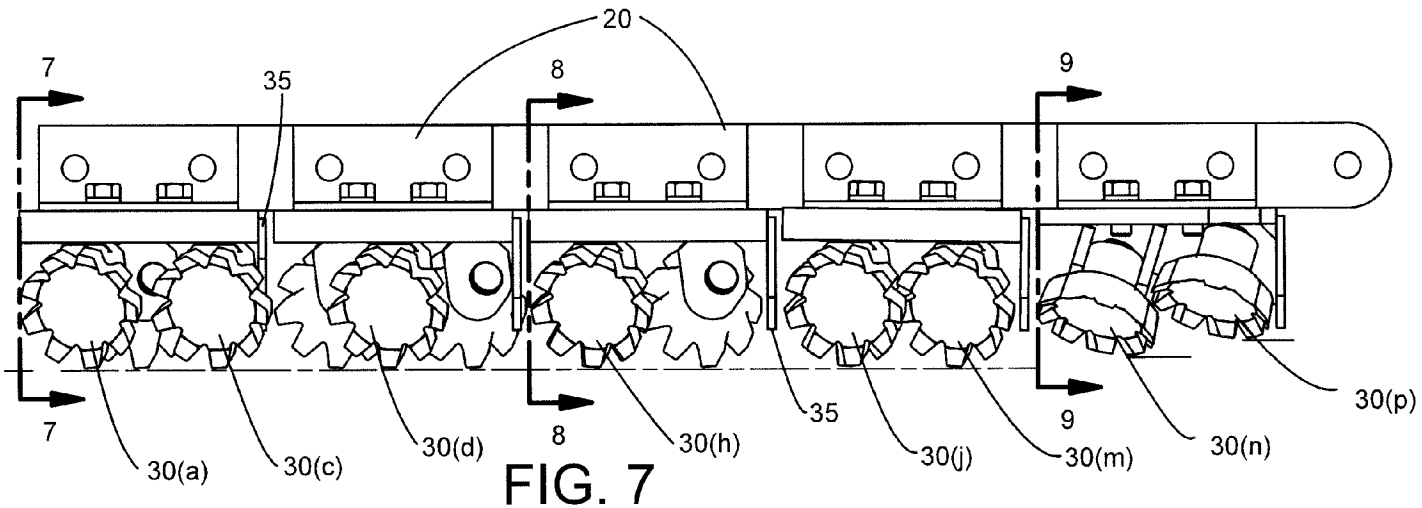
FIG. 7 is an enlarged side elevation of one segment of the cutter assembly used in the trencher of FIG. 1.

As an alternative to direct engagement of the shaft 31 with the hole in the mount 32, a wear member in the form of a sleeve 33 can surround the shaft 31 to provide a wear surface between the shaft 31 and the mount 32. A suitable spring steel is an example of an acceptable material for the sleeve. As shown in FIGS. 5, 6 and 7, a wear member can also be placed between the rear surface of the cutting element 30 and the mount. For example, the exploded views in FIGS. 5A and 5B show the wear member in the form of a washer 37 (e.g., hardened steel) disposed between the cutting element and mounting plate. Advantageously, the use of wear members 33, 37 reduces wear on the cutting elements and mounts, and provides an easily and inexpensively replaceable part when the wear members are worn thin. FIG. 6 shows a side view of an embodiment of a cutting element 30, mount 32 and washer 37 assembled together.

In certain applications, the outer working edge 38 of the cutting elements may be continuous, for example in a circular shape. However, in many applications where a more aggressive cutting action is desired, it may be preferable for the outer working edge to be notched or serrated so as to form teeth. For example, the cutting elements shown in FIGS. 2-6, each have multiple radial teeth 34 spaced around the circumference of the cutting element and projecting radially outwardly as well as in the axial direction from the cutting face 36 of the element (see FIG. 3). These teeth 34 form an interrupted cutting edge of each cutting element 30, thereby concentrating the cutting forces in the localized regions engaged by the teeth 34 at any given instant. This enhances the cutting action of the cutting elements 30, permitting them to penetrate much harder materials than would a round cutting element without any teeth. Moreover, the spaces between the teeth facilitate release of the loose material fractured by the cutting elements, so that the loose material can be collected and transported upwardly out of the trench by a drag plate 35 that extends outward from some carrier plates 22.

The cutting faces 36 of the cutting elements 30 are preferably dished out to form concave surfaces. This has the effect of lengthening the cutting teeth 34, and also further concentrates the cutting forces around the outer periphery of the cutting element 30, particularly at the outer working edge 38. The relieved central portions of the cutting face 36 also further facilitate removal of the loose material produced by the cutting action of the elements 30. Alternatively, the cutting faces 36 of the cutting elements 30 can be flat. For example, the cutting elements can be formed as simple wheels with or without teeth extending radially from an outer face of the wheel.

In accordance with embodiments of the present invention, each of the cutting elements 30 shown in FIGS. 2-11 is canted with respect to two mutually perpendicular planes.

Figure 12A:
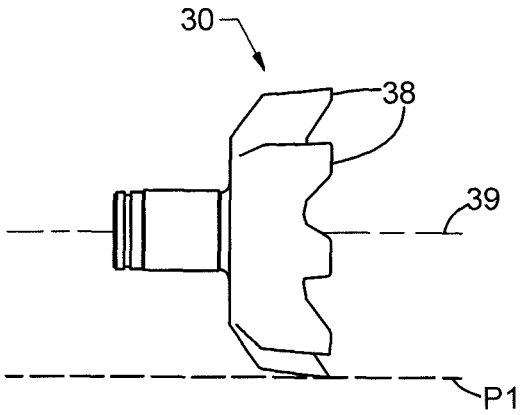
FIGS. 12A-12D are partial schematic diagrams illustrating various angles in the orientation of one of the cutting elements in the cutter assembly of FIGS. 1-11.

To demonstrate the directions in which the cutting elements are canted, FIGS. 12A-D show cutting elements 30 canted in various directions. To better understand the angles at which the cutting elements are canted, it should be understood that each cutting element depicted in FIGS. 12A-D is positioned above a surface represented by P1 and is mounted to a transport device 22 that is imparting a line of action to the cutting element that is out of the page. In this case, the cutting element 30 shown in FIG. 12A is not canted, so that the axis of rotation 39 of the cutting element is parallel to the surface P1 and is perpendicular to the line of action. This cutting element 30 shown in FIG. 12A is well aligned for ideal rolling of the outer working edge 38 along the surface represented by P1. However, this ideal rolling is not particularly advantageous for cutting the surface.

Figure 12B:
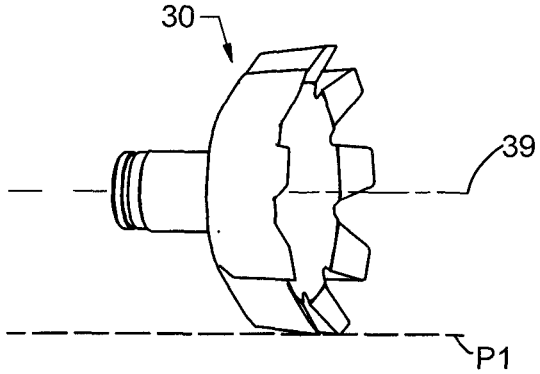

Thus, in order to improve the cutting action of the cutting elements 30 they are canted such that the axis is rotated forward in a plane parallel to the surface being cut P1, as shown in FIG. 12B, so that the cutting face 36 is turned slightly toward the line of action being imparted by the transport device 22. This angle is defined herein as the side angle $\alpha$, shown in FIG. 8. The side angle of the cutting element 30 improves the cutting performance of the cutting element by preventing ideal rolling, such that there is greater interaction between the cutting element and the material being cut. The side angle $\alpha$ also generates a larger cutting area of the cutting element. If the cutting elements are relatively thin, the side angle cant described above may be sufficient to achieve desired cutting action.

Figure 12C:
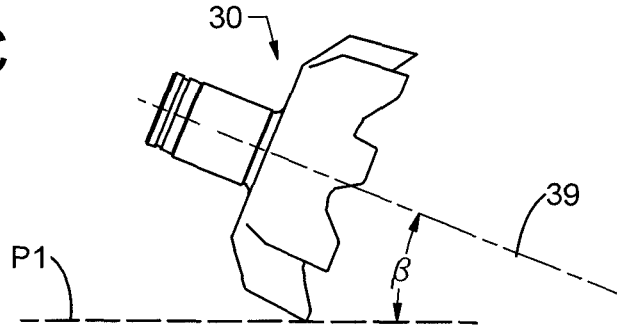
Figure 12D:
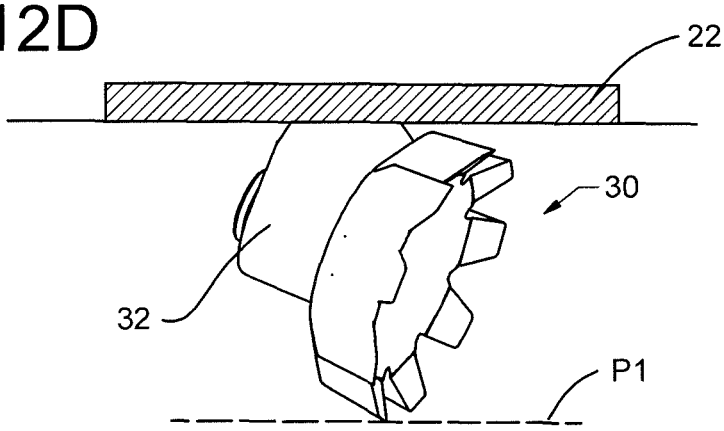

However, for thicker cutting elements 30, a second cant angle may provide further advantages. For example, the cutting elements may be canted as shown in FIG. 12C, with the axis of rotation being angled toward the surface being cut, such that the cutting face 36 is turned slightly toward the surface. This angle is defined herein as the tilt angle $\beta$. The tilt angle $\beta$ is beneficial for providing any teeth of the cutting element with a more aggressive cutting action angle. This can be clearly seen in FIG. 12C, where the teeth adjacent to the surface P1 are more pointed into the surface P1 compared to the teeth in FIG. 12A. The tilt angle $\beta$ is also advantageous for reducing the possibility of the rear portion of the cutting element dragging on or being compromised by the surface being cut.

The two angles $\alpha$ and $\beta$, by which the cutting elements 30 are canted, may be varied somewhat for different applications, and the optimum angles will depend in part on the particular material being cut and the material of which the cutting elements 30 are made. It is generally preferred, however, that each angle can be within the range of about 7.5° to 30° more or less. It has been found that angles within this range provide efficient cutting action without imposing an excessive load on the cutting elements 30. In the illustrative cutter assembly (FIG. 3), both the side angle $\alpha$ and the tilt angle $\beta$ of each cutting element 30 is fixed by that cutting element's mount 32 and/or the base of the mount that receives the shaft 31 of the cutting element in that mount.

Figure 4:
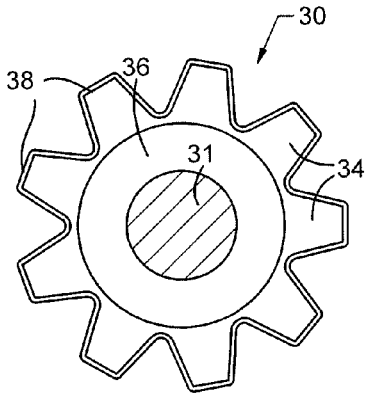
FIG. 4 is a section taken generally along line 4-4 in FIG. 3.

Referring now to FIGS. 2-4 for a more detailed description of the cutting action of the canted cutting elements 30, it will be assumed for the sake of discussion that the illustrative trencher is being used to cut a trench through concrete. Each time one of the cutting teeth 34 comes into engagement with the concrete, the advancing movement of the driven chain 16 causes the tooth 34 to be driven across the concrete face. Due to the cant of the cutting element, the pressure is exerted on the concrete by the cutting tooth 34 and is concentrated at one corner of the tip of the tooth, thereby facilitating the initial penetration of the tooth into the concrete. Then, as the freewheeling cutting element rotates as facilitated by the advancing movement of the chain, the cutting tooth that has penetrated the concrete moves both laterally and vertically at the same time because of the dual cant of the cutting element, thereby producing a rolling wedge pulling up action exerting a tensile (rather than compressive) load on the concrete. This wedging action is enhanced by the tapered or wedge-shaped cross-sectional configuration of the tooth 34 along its radius (see FIG. 3). Concrete and many other materials are much weaker in tension than in compression, and thus are more easily fractured by the tensile upward pulling load applied as this rolling wedge rotates forward. There is also less wear and tear on the cutting elements because the resistance offered by the concrete to tensile loads is far less than it is to compressive loads.

The rolling wedge action of the cutting elements breaks off the concrete in relatively large fragments, rather than abrading away the concrete through fractured compression loading as a dust or small particles. This type of cutting action is highly efficient and, therefore, can be carried out at relatively fast cutting rates while at the same time extending the life of the cutting elements.

As can be seen most clearly in FIGS. 2 and 8-11, the cutting elements 30 are laterally offset from each other so that the kerfs created in the surface being worked by the individual cutting elements overlap each other across the bottom of the trench with the distance between the centers of adjacent kerfs being the gauge of the individual cutters, thereby producing a relatively flat bottom surface in the trench. Depending on the material being cut, the gauge can be more or less than the particular gauge illustrated. In addition, selected cutting elements 30 are oriented to cut the side walls rather than the bottom of the trench so as to relieve the endmost bottom-cutting elements in a chain from a portion of the load that would otherwise be imposed thereon by dragging or compromising the outermost portion of the bottom cutting elements on the trench side walls. Thus, in the particular embodiment illustrated in FIGS. 7 and 8, the four clusters (each cluster is mounted on one carrier plate 22) of cutting elements 30(*a*)-30(*m*) are all oriented to cut the bottom of the trench. The carrier plate 22 may have a varied number of cutting elements 30 from in some case no cutting elements 30 to four or more cutting elements 30. The clusters are typically laterally offset from each other so that their kerfs or gauge overlap each other in a fairly regular pattern, as can be seen most clearly in FIG. 2B. This arrangement of the canted cutting elements 30 results in each cutting element cutting along only a relatively small segment of the outer working edge and corresponding trench bottom, which means that dependent on the material being trenched there may be only a few teeth of each cutting element engaging the material being cut at any given instant or where rock formations are being cut several teeth of the cutting elements may be engaging t the same time the material being cut. If the material being cut is relatively thin such as concrete, the cutting forces applied to the concrete or other material being cut are further concentrated by the toothed cutting elements 30.

Figure 8:
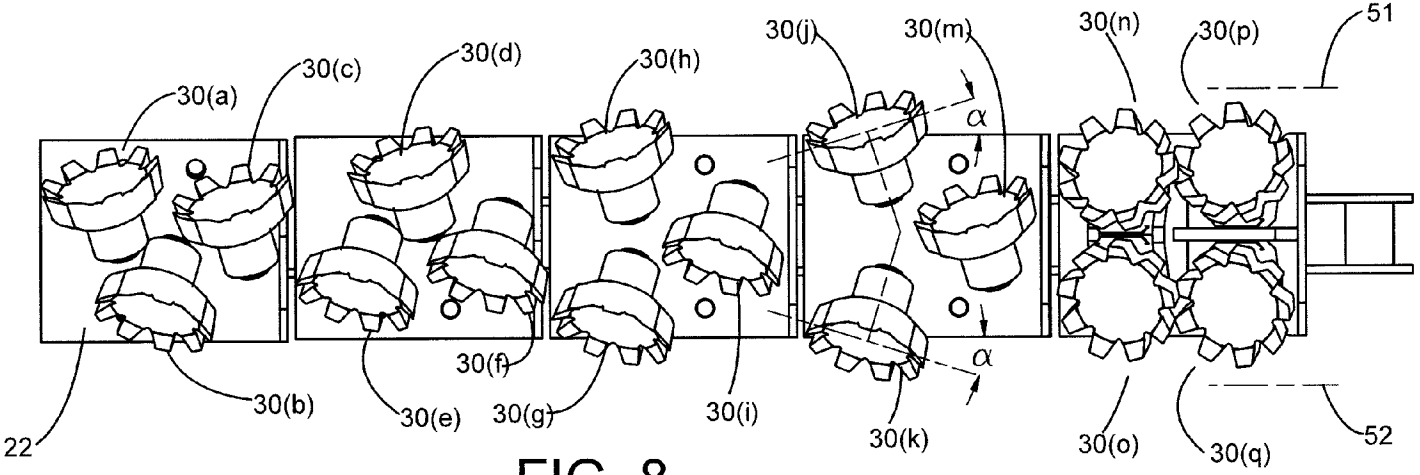
FIG. 8 is a top plan view of the segment of the cutter assembly illustrated in FIG. 7.

The lateral offsets or gauge among the various cutting elements 30(*a*)-30(*m*) in FIGS. 7 and 8 can be achieved by mounting the various cutting elements at different lateral positions, and by mounting the cutting elements to face either the right or left side of the trench. For example, the two pairs of cutting elements 30(*a*), 30(*b*) and 30(*h*), 30(*g*) in FIGS. 7 and 8 face in the same respective directions, and with the same side angles α, but are mounted at slightly different lateral positions relative to the surface being cut. Consequently, the kerfs of these four cutting elements 30(*a*), 30(*b*) and 30(*h*), 30(*g*) are laterally offset from each other, as can be clearly seen in FIGS. 9 and 10. Similarly, the two cutting elements 30(*c*) and 30(*i*) have the same tilt and side angles, but are mounted in slightly different lateral positions and facing in opposite directions to achieve the desired lateral offset in their respective kerfs (again see FIGS. 9 and 10).

The lateral offset or gauge between the cutting elements 30 and the actual number of cutting elements can be customized in accordance with the particular material being trenched or cut through. Depending on the material being trenched, both the gauge and the actual number of cutting elements 30 can be increased or decreased. For example in softer materials such as dirt, loam or relatively soft clay that is easily penetrated, fewer cutting elements 30 may be required and, in fact, some of the endless chain driven transport device segments 22 may have no cutting elements on them and simply include a paddle 55 for transporting cut material out of the trench, as shown in FIGS. 18-21.

Figure 14:
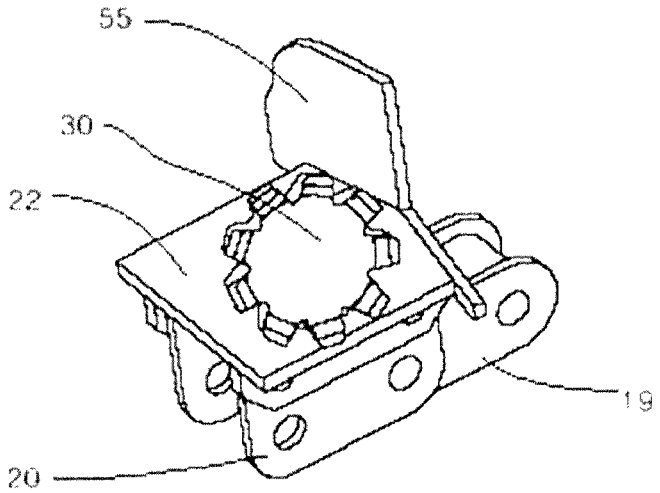
FIGS. 14 and 15 show views of a segment of a transport device with a cutting element and a paddle.
Figure 15:
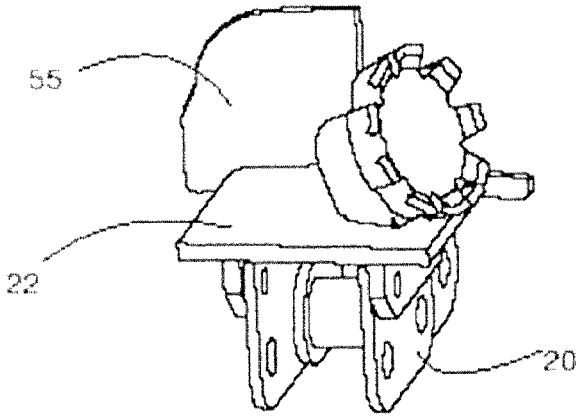
Figure 16:
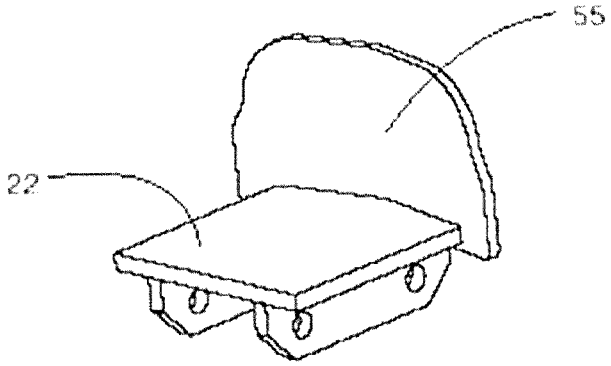
FIG. 16 shows a segment of a transport device without a cutting element.

An example of such a transport device segment 22 is shown in detail in FIGS. 14-16. An example of such an embodiment could include one driven transport device with cutting element(s) 30 for every two or more driven transport device segments 22 with paddle(s) only. Two embodiments of such a transport device or chain are shown in FIGS. 18-21. The embodiment illustrated in FIGS. 18 and 19 has a cutting element on every other segment 22. The embodiment illustrated in FIGS. 20 and 21 has a cutting element 30 on every third segment 22. In these embodiments, the segments 22 each include a paddle 55. FIGS. 14 and 15 show a segment 22 with a cutting element 30 at different perspective views, whereas FIG. 16 shows a segment with no cutting element 30.

Figure 17:
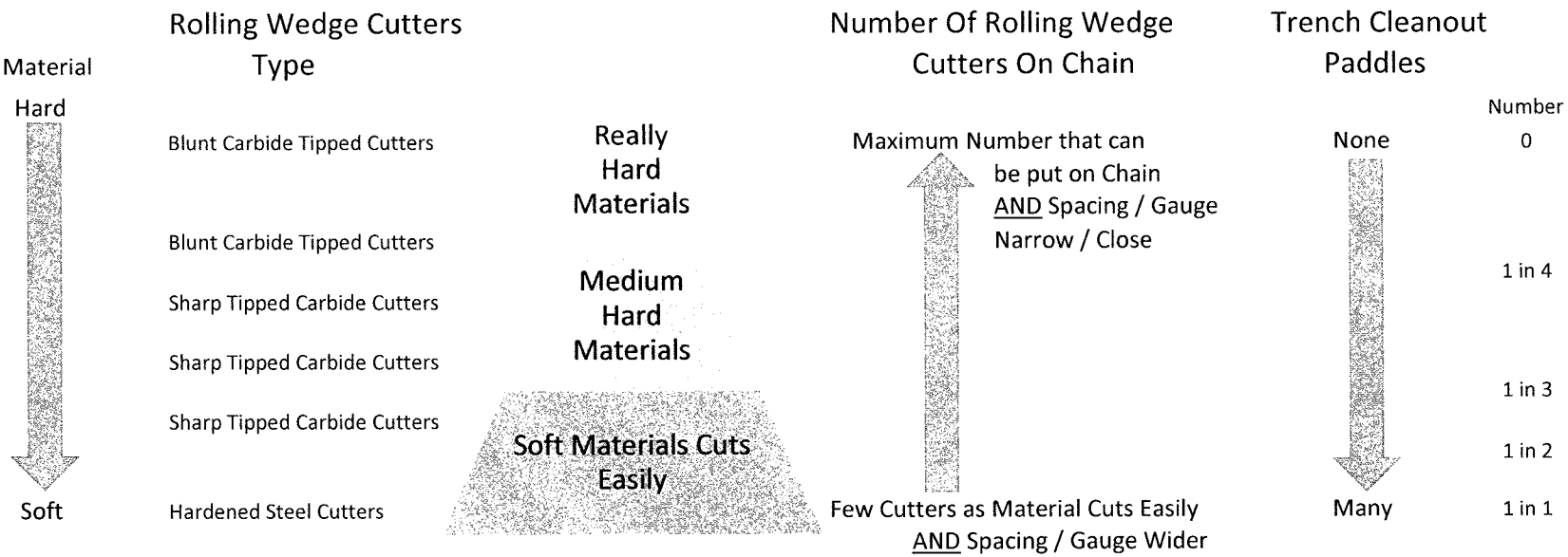
FIG. 17 is a diagram illustrating the relationship between types of cutting elements and configurations of the transport device.
Figure 18:
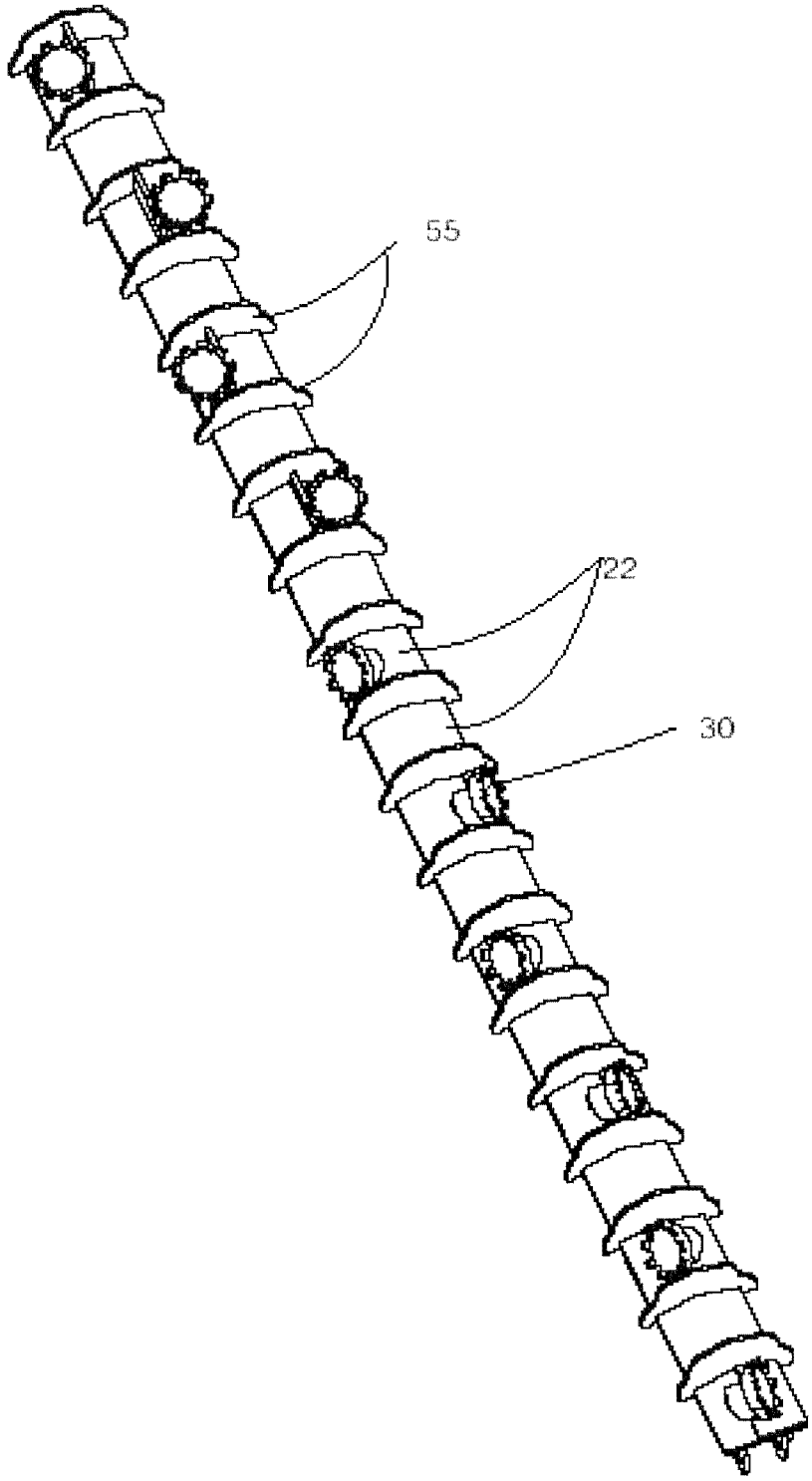
FIGS. 18 and 19 show different views of a transport device including segments without cutting elements.
Figure 19:
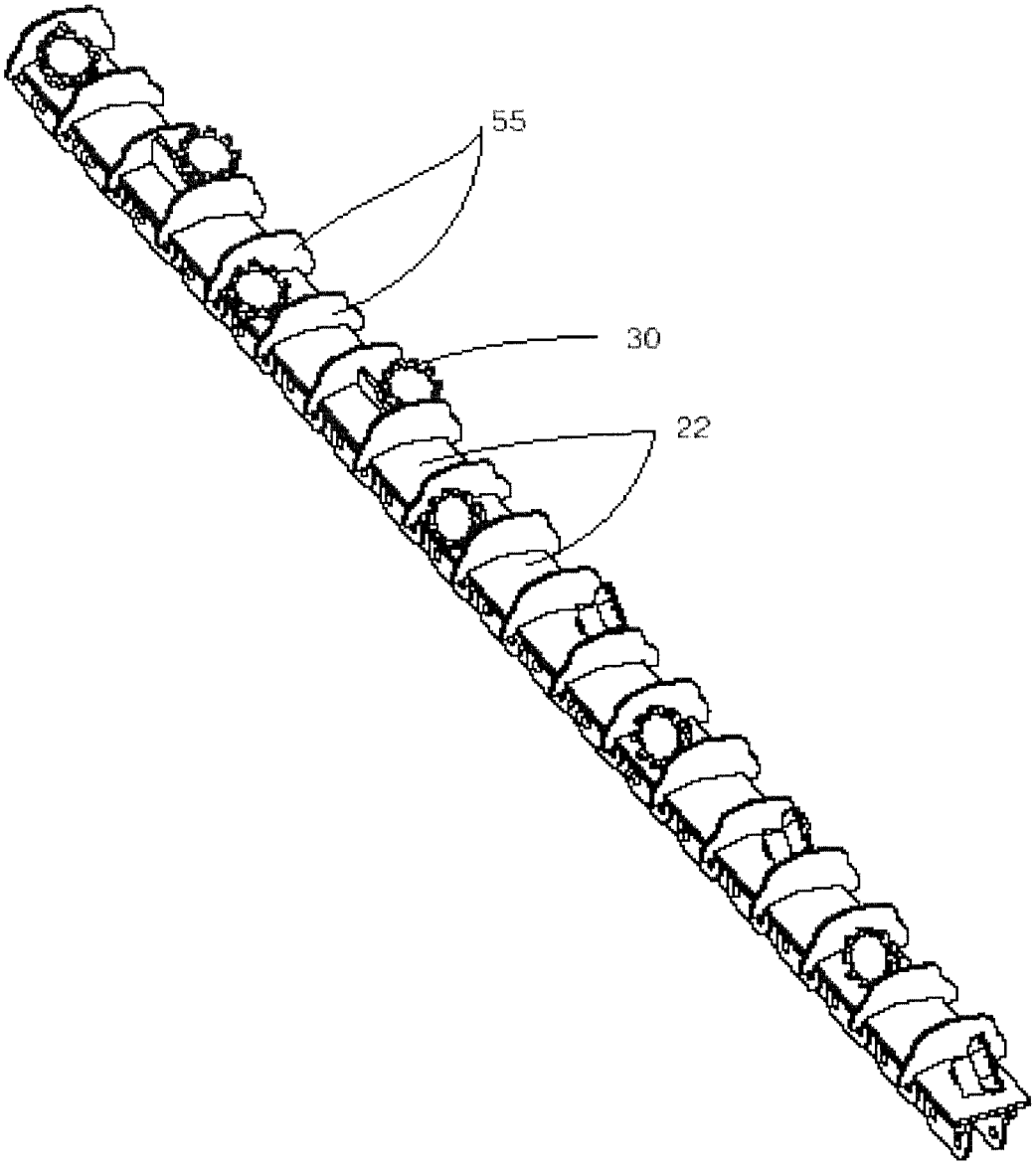
Figure 20:
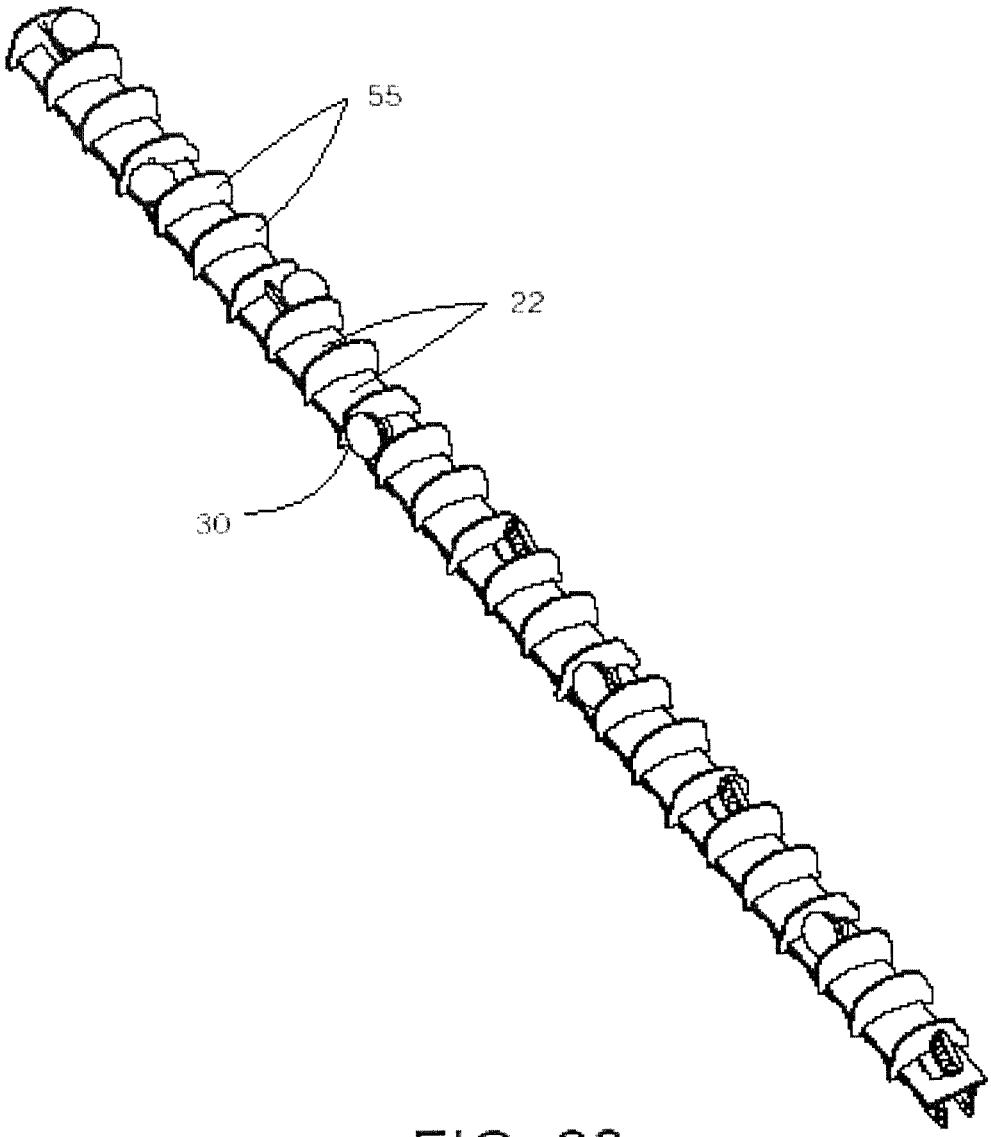
FIGS. 20 and 21 show different views of another transport device including segments without cutting elements.
Figure 21:
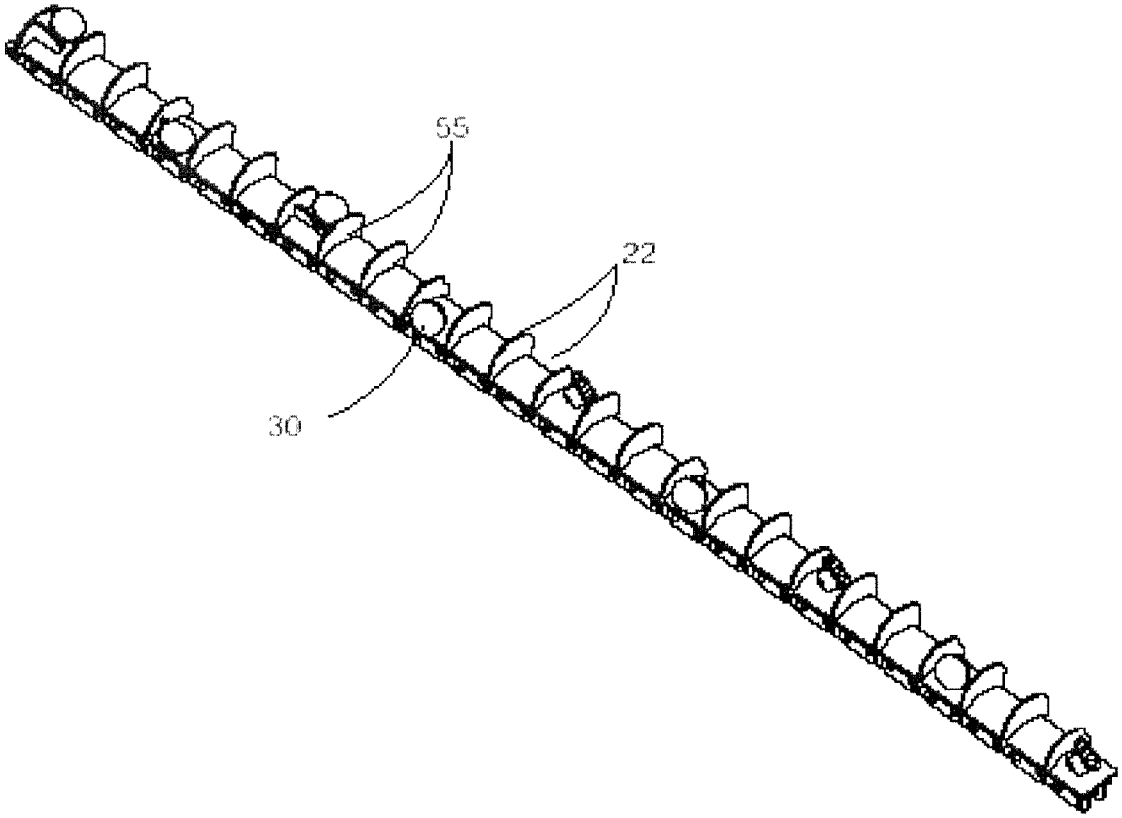

The embodiments illustrated in FIGS. 18-21 demonstrate examples of a range of configurations for the cutting elements 30 and paddles 55 that can be suitably matched to the material being worked. FIG. 17 illustrates general relationships of the hardness of the material being worked and the densities of the cutting elements 30 and paddles 55. For example, in very soft material that is relatively easily cut, at least some of the driven transport device segments 22 that include cutting elements 30 may have a paddle 55 with a removed portion directly behind the cutting element, as shown in FIGS. 18 and 19, in order to relieve any material cut by the cutting element from gumming up the cutting element. And, at the same time, the gauge of these cutting elements 30 in soft materials can be measurably increased.

Figure 22:
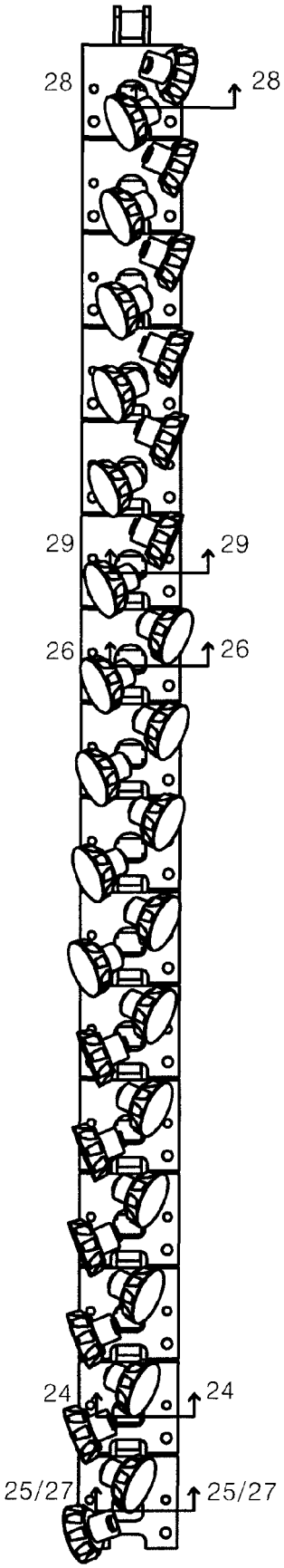
FIGS. 22 and 23 show different views of still another transport device including cutting elements on all segments.
Figure 23:
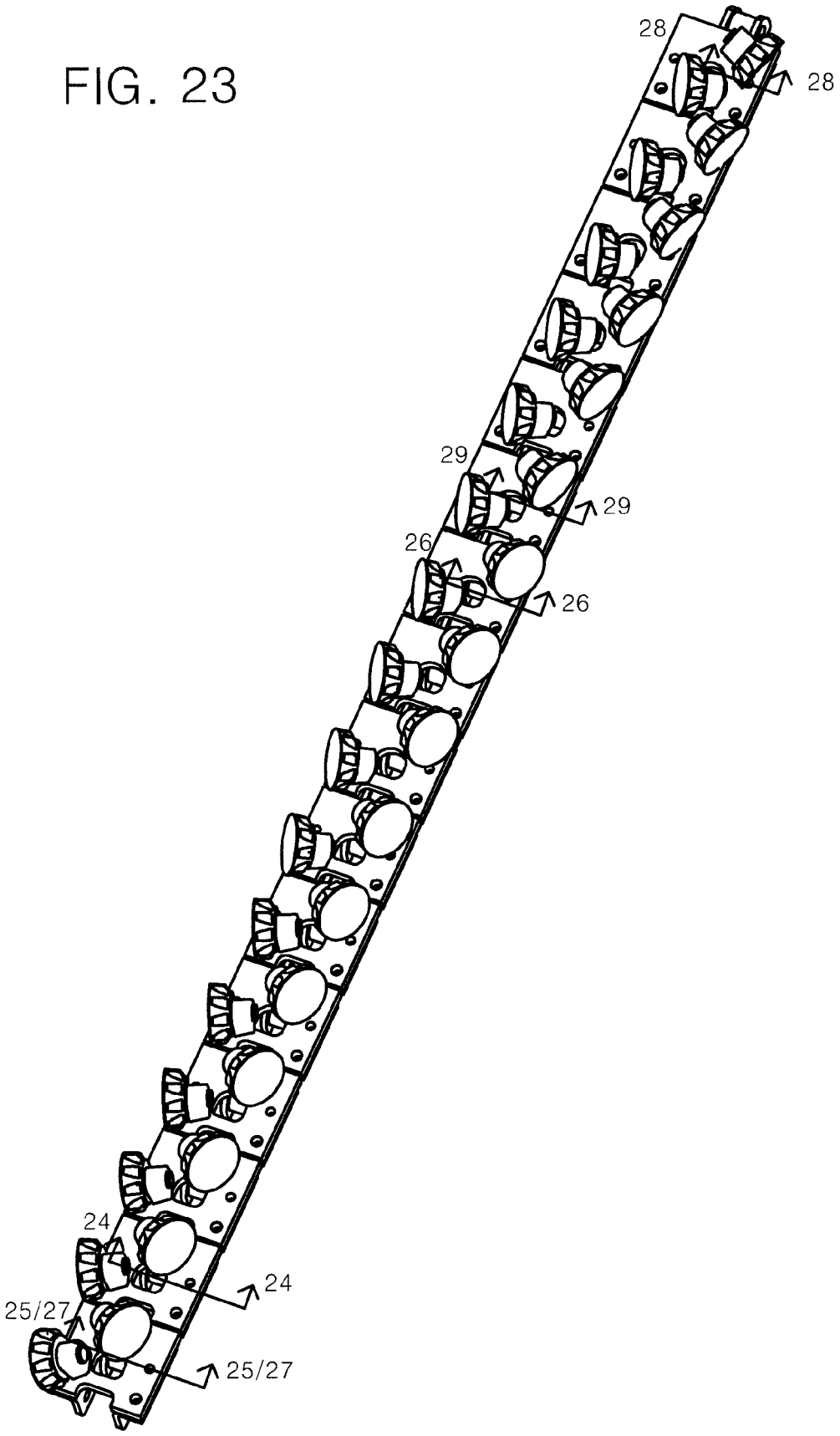

In the alternative, when trenching through relatively more difficult materials to penetrate, such as shale, limestone and other higher compressive strength earthen materials and rocks, and asphalt, the number of cutting elements on the driven transport device can be increased as trenching difficulty increases, and the gauge or distance between the cutting elements on the driven transport device can also be decreased. An example of such an embodiment may include one driven transport device with cutting element(s) for every driven transport device segment with a paddle such as shown in FIGS. 22-23. At the same time the gauge or distance between cutting elements in semi difficult material to trench can be decreased.

When the material being trenched is extremely hard and difficult to penetrate, the segments 22 of the driven transport device can be populated with near the maximum if not the maximum number of cutting elements 30. An example of such materials includes concrete, reinforced concrete and extremely hard rock typically found in mining applications. In an example of such an embodiment, each segment 22 of the driven transport device has one or more cutting elements mounted on it. Moreover, the gauge or distance between cutting elements in such extremely hard and difficult materials to trench can be further decreased to a minimum, which in some cases depends on the diameter of the cutting elements. For example, the gauge or cutting spacing between cutting elements could be as little as 0.25 or typically less than 0.375 inches.

The table below is a master list showing the possible spacing of the cutting elements 30 in an exemplary embodiment. The master list assumes a 0.125 inch spacing between adjacent elements 30. The table is set up for a trench of 8.5 inch width. If the trench is wider, the table expands appropriately.

Master List Rolling Wedge Cutters
To Pull from When Configuring A Cutter Chain
This Would be for an 8.5 Inch Wide Trench
Clearly It can Be Expanded to Any Reasonable Trench Width
Distance from Trench Center Line To Cutter In Trench

| Cutter # | .125 Inch Cutter Gauge Spacing | Cutter Spacing |
|---|---|---|
| 1 | 0.000 | Center |
| 2 | **0.125 | 0.125 |
| 3 | 0.250 | 0.125 |
| 4 | 0.375 | 0.125 |
| 5 | 0.500 | 0.125 |
| 6 | **0.625 | 0.125 |
| 7 | 0.75 | 0.125 |
| 8 | **0.875 | 0.125 |
| 9 | 1.000 | 0.125 |
| 10 | 1.125 | 0.125 |
| 11 | 1.250 | 0.125 |
| 12 | **1.375 | 0.125 |
| 13 | 1.5 | 0.125 |
| 14 | **1.625 | 0.125 |
| 15 | 1.750 | 0.125 |
| 16 | 1.875 | 0.125 |
| 17 | 2.000 | 0.125 |
| 18 | **2.125 | 0.125 |
| 19 | 2.25 | 0.125 |
| 20 | **2.375 | 0.125 |
| 21 | 2.500 | 0.125 |
| 22 | 2.625 | 0.125 |
| 23 | 2.750 | 0.125 |
| 24 | **2.875 | 0.125 |
| 25 | 3 | 0.125 |
| 26 | **3.125 | 0.125 |
| 27 | 3.250 | 0.125 |
| 28 | 3.375 | 0.125 |
| 29 | 3.500 | 0.125 |
| 30 | **3.625 | 0.125 |
| 31 | 3.75 | 0.125 |
| 32 | **3.875 | 0.125 |
| 33 | 4.000 | 0.125 |
| 34 | 4.125 | 0.125 |
| 35 | 4.250 | 0.125 |
| 36 | **4.375 | 0.125 |
| 37 | 4.5 | 0.125 |

**Indicates a Special Cutter Configuration Which Would Typically Not Be Used

From the Master TABLE 1 above, a variety of different chains can be constructed to best match the material being worked. TABLE 2 below shows three possible configurations derivable from the master spacing in TABLE 1.

| 8.5 inch Basic Rolling Wedge Trench Width<br>0.250 Rolling Wedge Cutter Gauge<br>Starting from Center of Trench 4.25 inches of Trench Width<br>Either side of Trench Center Line | | | | | | | | |
|---|---|---|---|---|---|---|---|---|
| Distance each Cutter From Trench Cutter Line | | | Distance each Cutter From Trench Center Line | | | Distance each Cutter From Trench Center Line | | |
| Cutter # | .250 Inch Cutter Gauge | Cutting Spacing | Cutter # | .500 Inch Cutter Gauge | Cutting Space | Cutter # | 1.000 Inch Cutter Gauge | Cutter Spacing |
| 0 | 0.000 | 0.250 | 0 | 0.000 | | 0 | 0.000 | |
| 1 | 0.250 | 0.250 | 1 | 0.500 | 0.500 | 1 | 1.000 | 1.000 |
| 2 | 0.500 | 0.250 | 2 | 1.00 | 0.500 | 2 | 2.000 | 1.000 |
| 3 | 0.750 | 0.250 | 3 | 1.500 | 0.500 | 3 | 3.000 | 1.000 |
| 4 | 1.000 | 0.250 | 4 | 2.000 | 0.500 | 4 | 4.000 | 1.000 |
| 5 | 1.250 | 0.250 | 5 | 2.500 | 0.500 | 5 | 4.250 | 0.250 |
| 6 | 1.500 | 0.250 | 6 | 3.000 | 0.500 | | | |
| 7 | 1.750 | 0.250 | 7 | 3.500 | 0.500 | | | |
| 8 | 2.000 | 0.250 | 8 | 4.000 | 0.500 | | | |
| 9 | 2.250 | 0.250 | 9 | 4.250 | 0.250 | | | |
| 10 | 2.500 | 0.250 | | | | | | |
| 11 | 2.750 | 0.250 | | | | | | |
| 12 | 3.000 | 0.250 | | | | | | |
| 13 | 3.250 | 0.250 | | | | | | |
| 14 | 3.500 | 0.250 | | | | | | |
| 15 | 3.750 | 0.250 | | | | | | |
| 16 | 4.000 | 0.250 | | | | | | |
| 17 | 4.250 | 0.250 | | | | | | |
| Number of Cutters In Cutter Sequence before Cutters Begin to Repeat the Cutting Sequence | | | Number of Cutter in Cutter Sequence before Cutters Begin to Repeat the Cutting Sequence | | | Number of Cutter in Cutter Sequence before Cutters Begin to Repeat the Cutting Sequence | | |

TABLE 3 below illustrates an alternative spacing at 0.375 inch intervals.

| 8.5 inch Basic Rolling Wedge Trench Width<br>0.375 Rolling Wedge Cutter Gauge<br>Starting from Center of Trench 4.25 inches of Trench Width<br>Either side of Trench Center Line | | | | | | | | |
|---|---|---|---|---|---|---|---|---|
| Distance From Trench Center Line | | | Distance each Cutter From Trench Center Line | | | Distance each Cutter From Trench Center Line | | |
| Cutter # | .375 inch Cutter Gauge | Cutter Spacing | Cutter # | .750 Inch Cutter Gauge | Cutter Spacing | Cutter # | 1.500 Inch Cutter Gauge | Cutter Spacing |
| 1 | 0.000 | 0.375 | 1 | 0.000 | 0.750 | 1 | 0.000 | |
| 2 | 0.375 | 0.375 | 2 | 0.750 | 0.750 | 2 | 1.500 | 1.500 |
| 3 | 0.750 | 0.375 | 3 | 1.500 | 0.750 | 3 | 3.000 | 1.500 |
| 4 | 1.125 | 0.375 | 4 | 2.250 | 0.750 | 4 | 4.500 | 1.500 |
| 5 | 1.500 | 0.375 | 5 | 3.000 | 0.750 | | | |
| 6 | 1.875 | 0.375 | 9 | 3.750 | 0.750 | | | |
| 7 | 2.250 | 0.375 | 7 | 4.500 | 0.750 | | | |
| 8 | 2.625 | 0.375 | | | | | | |
| 9 | 3.000 | 0.375 | | | | | | |
| 10 | 3.375 | 0.375 | | | | | | |
| 11 | 3.750 | 0.375 | | | | | | |
| 12 | 4.125 | 0.375 | | | | | | |
| 13 | 4.500 | 0.375 | | | | | | |
| Number of Cutters in Cutter Sequence before Cutters Begin to Repeat the Cutting Sequence | | | Number of Cutters in Cutter Sequence before Cutters Begin to Repeat the Cutting Sequence | | | Number of Cutters in Cutter Sequence before Cutters Begin to Repeat the Cutting Sequence | | |

Figure 11:
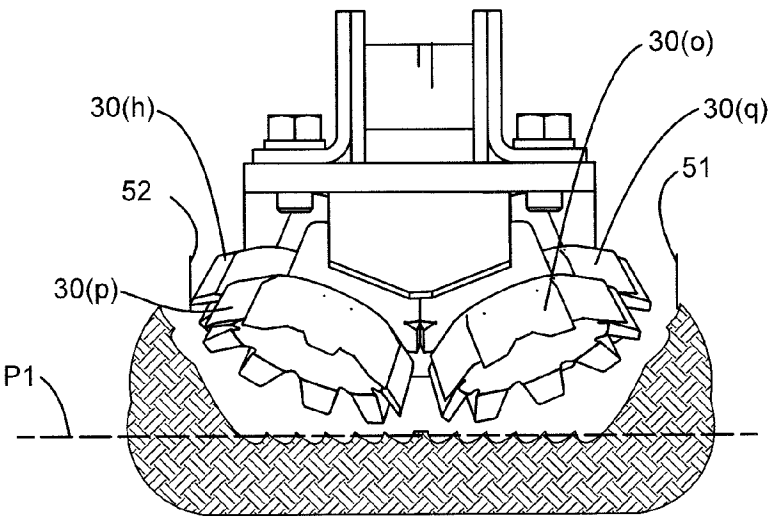
FIG. 11 is a section taken generally along line 9-9 in FIG. 7.
Figure 10:
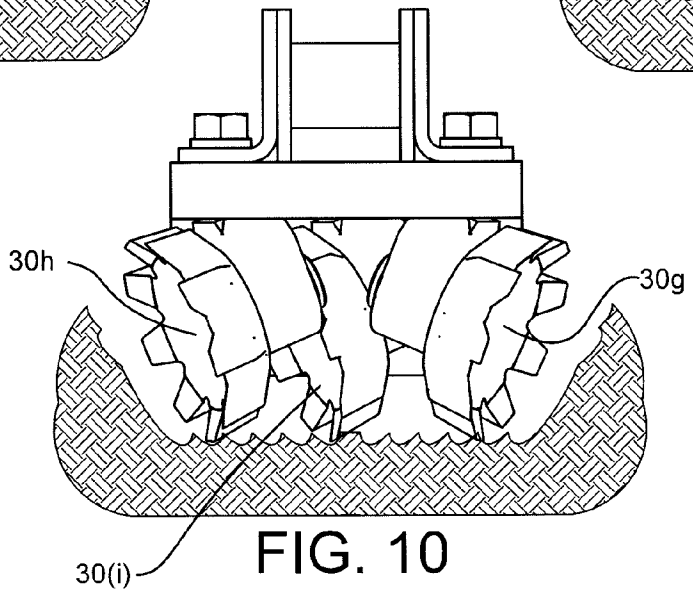
FIG. 10 is a section taken generally along line 8-8 in FIG. 7.
Figure 9:
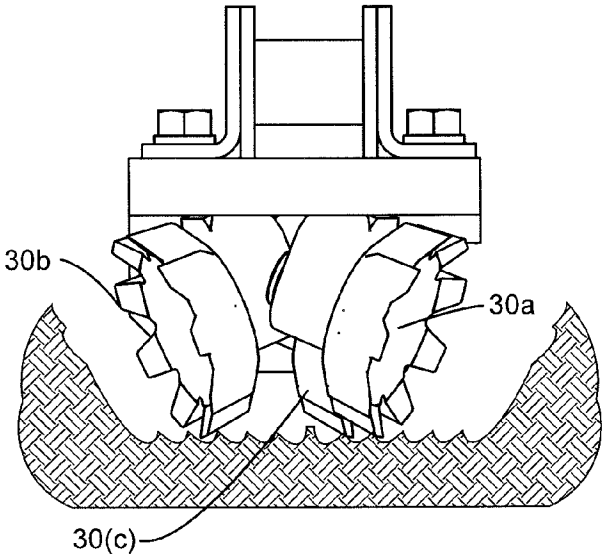
FIG. 9 is a section taken generally along line 7-7 in FIG. 7.

The particular group of cutting elements 30 oriented to cut the side walls 51 and 52 of the trench in the illustrative embodiment in FIGS. 7 and 8 are the elements 30(*n*) through 30(*q*) (best seen in FIG. 8). For these four cutting elements 30, therefore, the planes of reference for these cutting elements become the respective sidewalls of the trench as best seen in FIG. 11. For example, the two cutting elements 30(*n*) and 30(*p*) are canted at a common side angle β relative to one sidewall 52 of the trench, and the other two cutting elements 30(*o*) and 30(*q*) are canted at the same side angle relative to the other sidewall 51 of the trench.

Figure 2A:
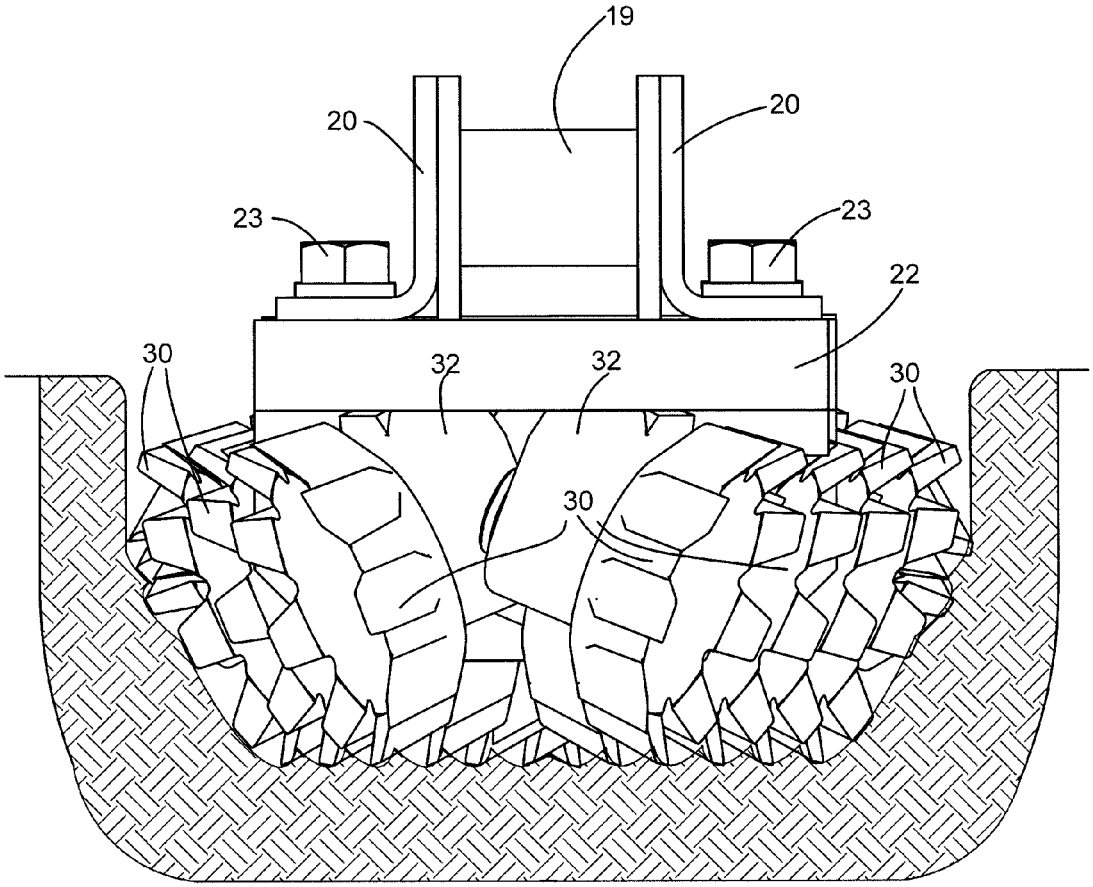
FIG. 2A is an enlarged section taken generally along the line 2-2 in FIG. 1.
Figure 2B:
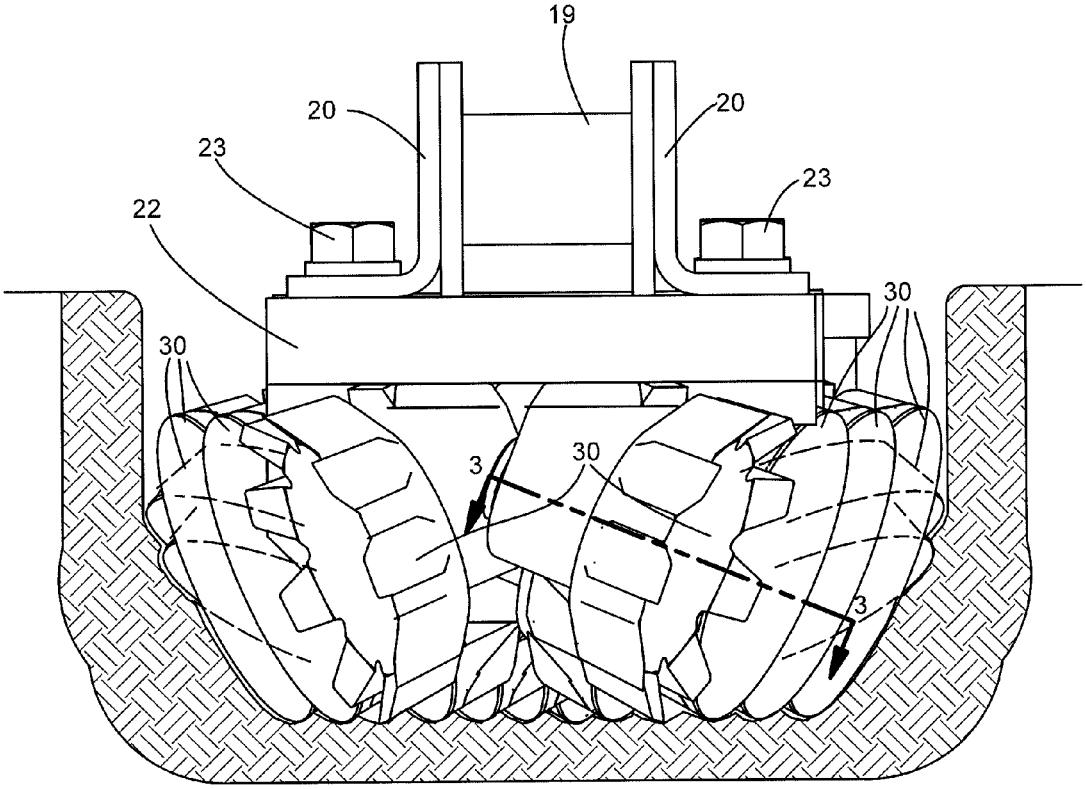
FIG. 2B is a schematic depiction of the section of FIG. 2A illustrating the paths of the free-wheeling cutting elements.

As can seen most clearly in FIG. 2B, the side-cutting elements 30(*n*)-30(*q*) are effective in cutting the side walls 51 and 52 of the trench in order to prevent dragging or compromising of the rear portion of any of the trench bottom cutting elements that would otherwise contact the side walls. That is, in the absence of the side-cutting elements 30(*n*)-30(*q*), the two cutting elements closest to the sides of the trench walls would cut the bottom of the trench along a relative short portion of the outer working surface 38 as they roll along the bottom of the trench. However, the rear portions of the cutting elements that extend outward laterally would also drag along the side walls of the trench and be subjected to significant wear. The provision of the side-cutting elements 30(*n*)-30(*q*) thus results in a substantially equal sharing of the cutting load among all the cutting elements, including the side-cutting elements themselves. This relatively equal distribution of the cutting load is apparent from FIG. 2.

Figure 24:
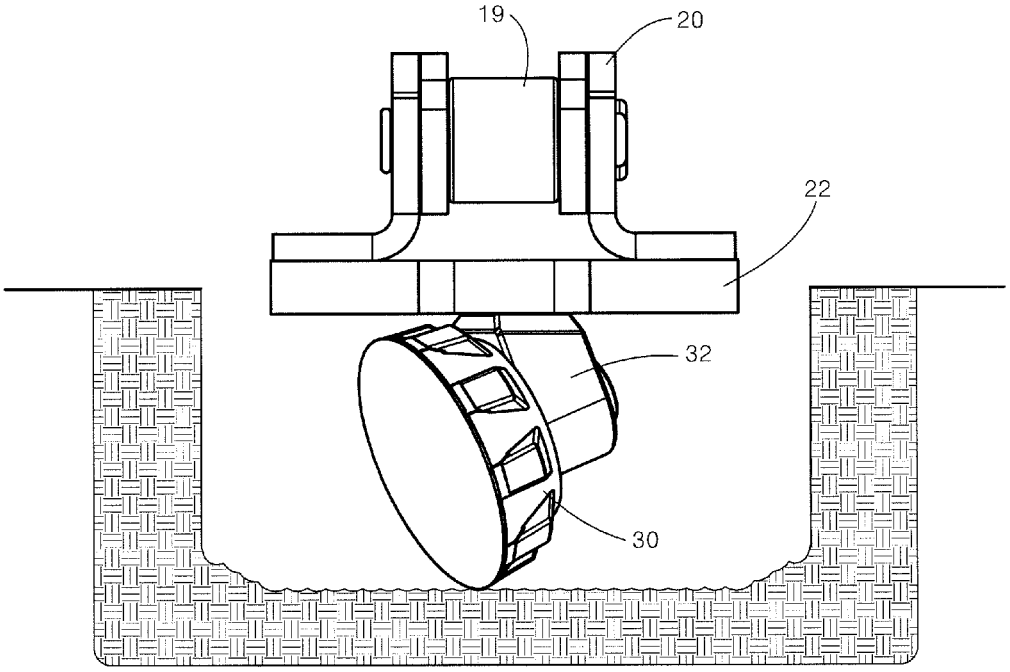
FIGS. 24-29 show different views of the transport device in FIGS. 22 and 23 taken along its length.
Figure 25:
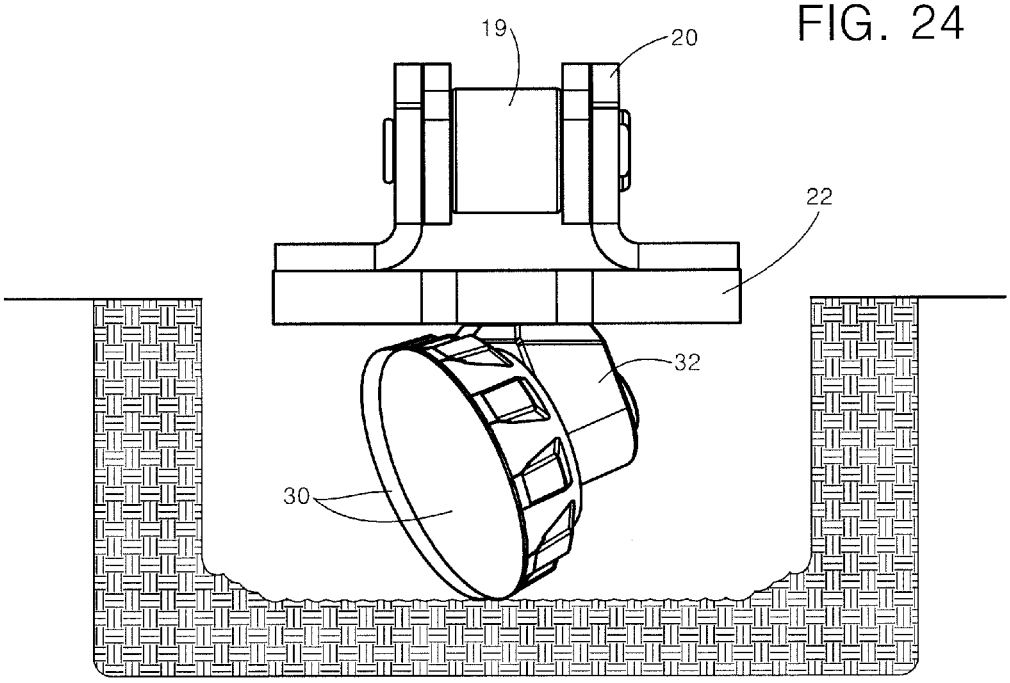
Figure 26:
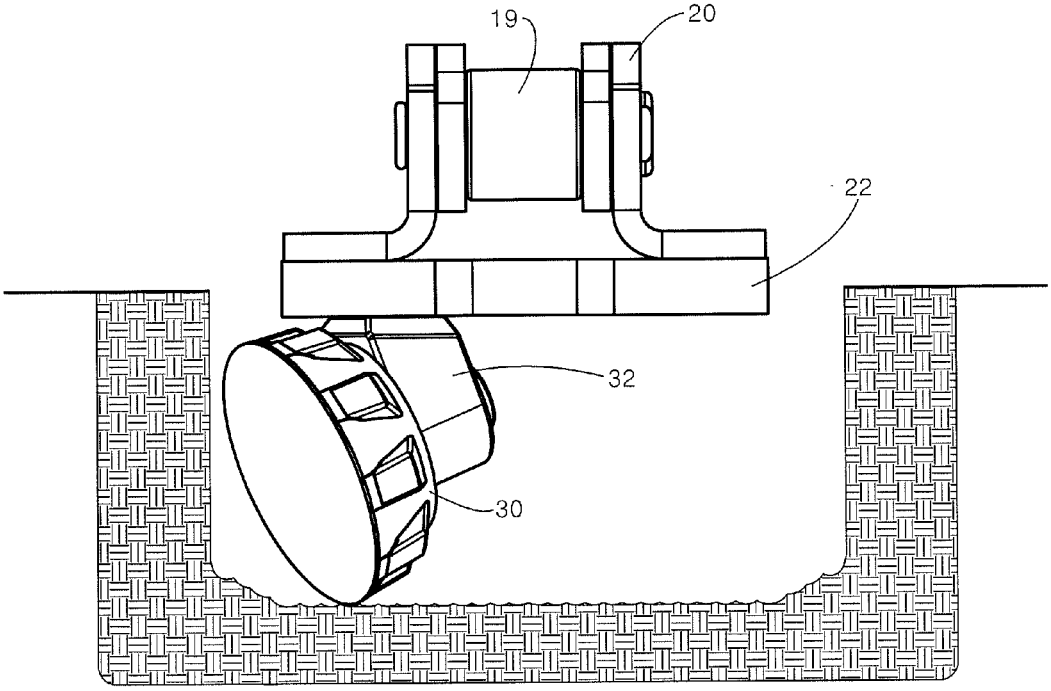
Figure 27:
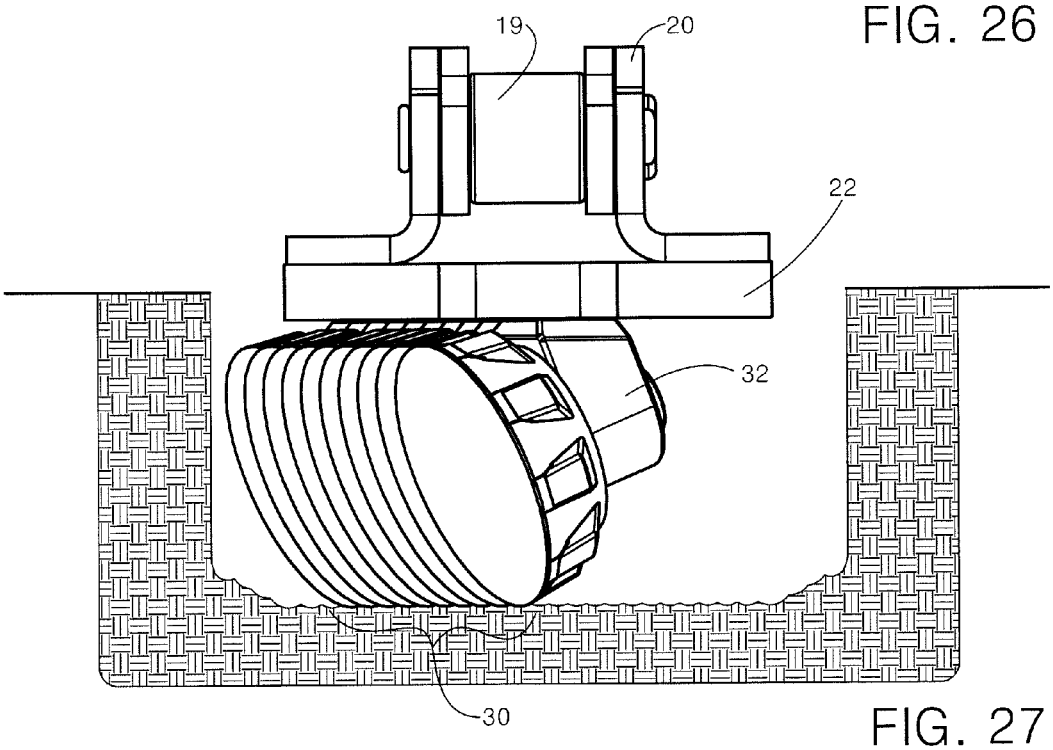
Figure 28:
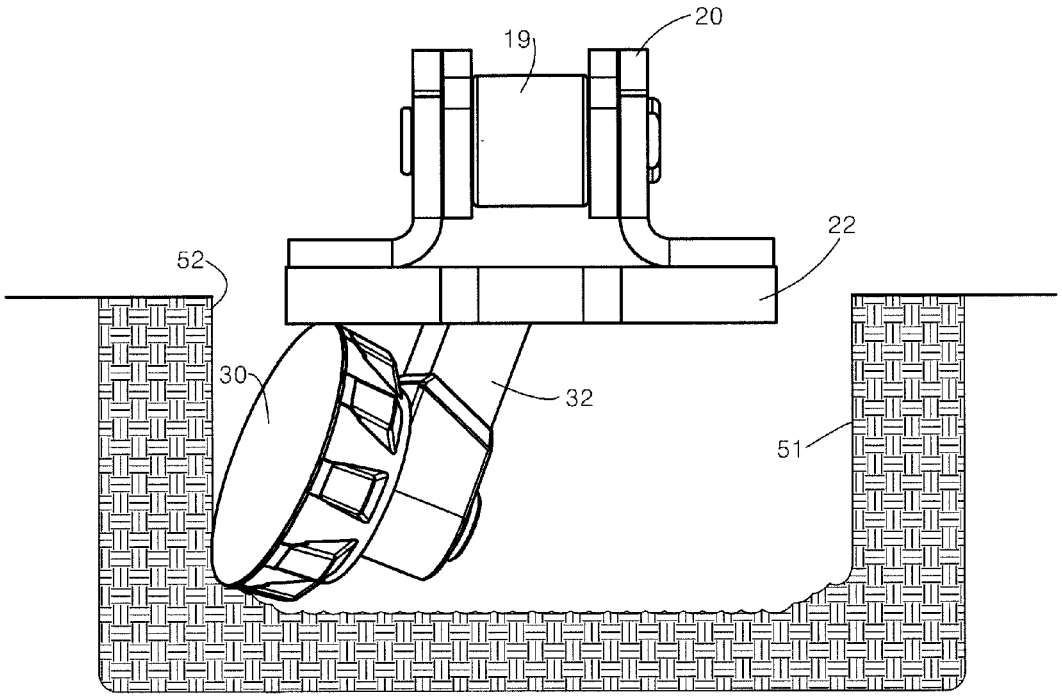
Figure 29:
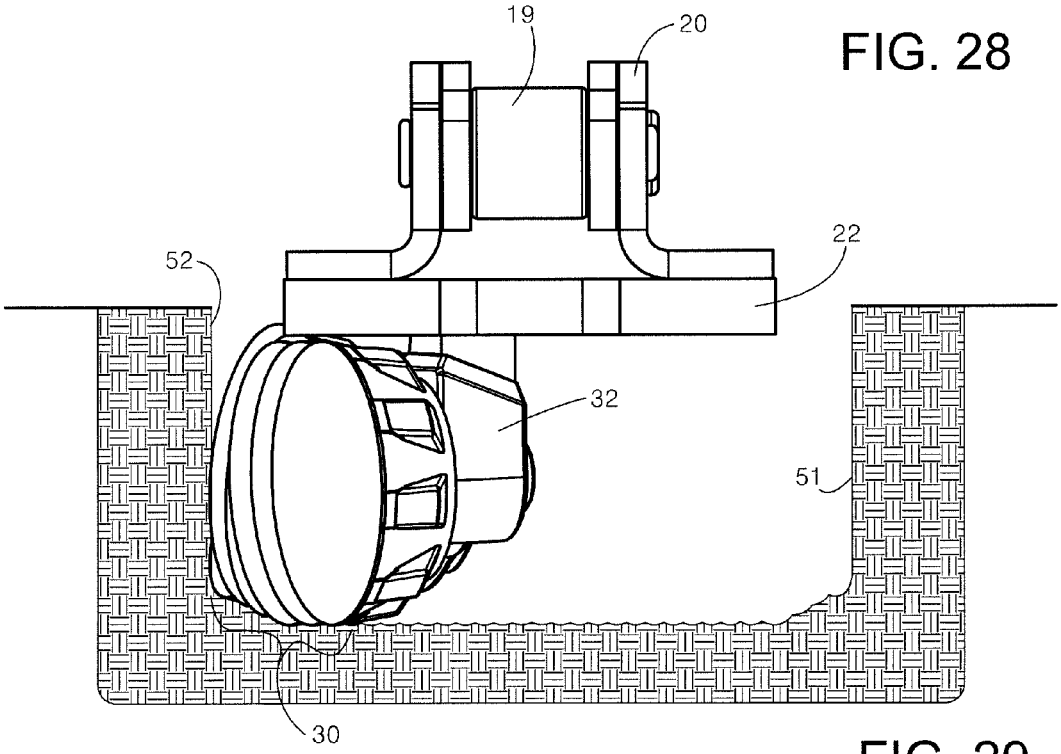

In an alternative arrangement illustrated in FIGS. 22-29, certain cutting elements 30 may be canted and tilted at angles allowing for the cutting of the extreme corners of the trench. The cant and tilt angles for cutting the corners of the trench are different from the cant and tilt angles required to cut the bottom of the trench or the sidewalls. Representative cutting elements 30 for cutting the extreme bottom of the trench are shown in FIGS. 24 and 25 as cutting elements 30. Representative cutting elements 30 for cutting the extreme sidewalls of the trench are shown in the embodiment of FIGS. 7 and 8 as elements 30(*n*) thru 30(*q*). To cut the extreme corners for the embodiment of FIGS. 22-29, the cant and tilted cutting element 30 angles can be as shown in FIGS. 28 and 29. FIGS. 28 and 29 are views taken along the length of the chain as shown by the section lines 28-28 and 29-29, respectively in FIGS. 22 and 23.

It will be understood that the entire group of cutting elements 30 illustrated in the embodiment of FIGS. 7-11 and 22-29 is repeated many times along the length of the chain 16. Within each of these repetitive groups, the cutting elements 30 are symmetrically distributed with respect to the centerline of the chain 16. This symmetrical distribution tends to balance the side thrust loads imposed on the chain during a cutting operation, thereby reducing the side thrust stresses on the chain assembly and prolonging its life.

In the illustrated embodiments of the invention, the cutter assembly is embodied as a trencher and the transport device is a chain that imparts a line of action to the cutting elements that remains linear for the portion of the chain's path where the cutting elements contact the surface being cut. However, the cutting assembly can be implemented in other embodiments, where the transport device takes on other forms. For example, the transport device could be designed as a large rotating body with the freewheeling cutting elements mounted thereon. In such an embodiment, the freewheeling cutting elements could be mounted to an outer circumference of the rotating body or to a face of the rotating body. For example, the transport device could be a large drum that forms a profiling machine. In this case, the cutting elements could be mounted in a freewheeling fashion to the circumference of the drum, which is spun to cut away at a surface. In another embodiment, the cutter assembly could be embodied as a rock wheel, with the wheel acting as the transport device and the cutting elements mounted in a freewheeling manner to the outer circumference of the wheel. In yet another example embodiment, the cutting elements could be mounted to a shaft that acts as the transport device so as to form a type of drill or boring machine. In such a case, the cutting elements could be mounted on the outer circumference of the shaft and/or on the end face of the shaft. Furthermore, the end face of the shaft could be flat, or could have a profile, such as a cone shape. In each of these cases, the transport device would have a rotational, rather than linear, movement and the line of action of the cutting elements would continuously change. However, the freewheeling cutting elements would still be canted and tilted to roll against the surface being cut and would be cutting material away from this surface.

Figure 13A:
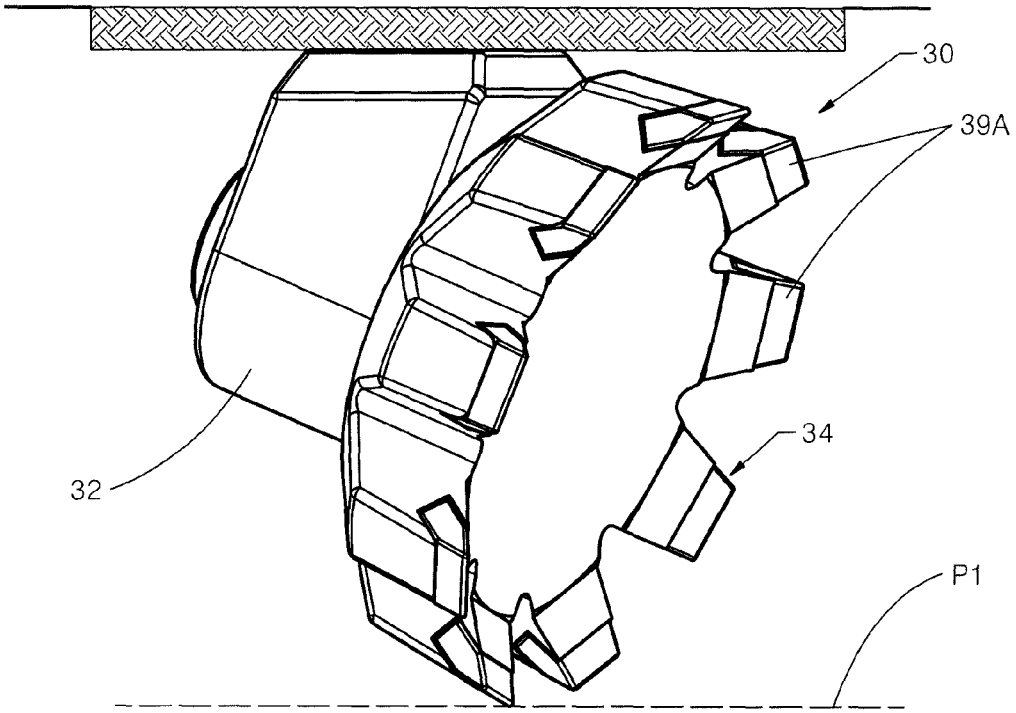
FIGS. 13A and 13B show other embodiments of a cutting element where the cutting elements include sharp and blunt carbide tips.
Figure 13B:
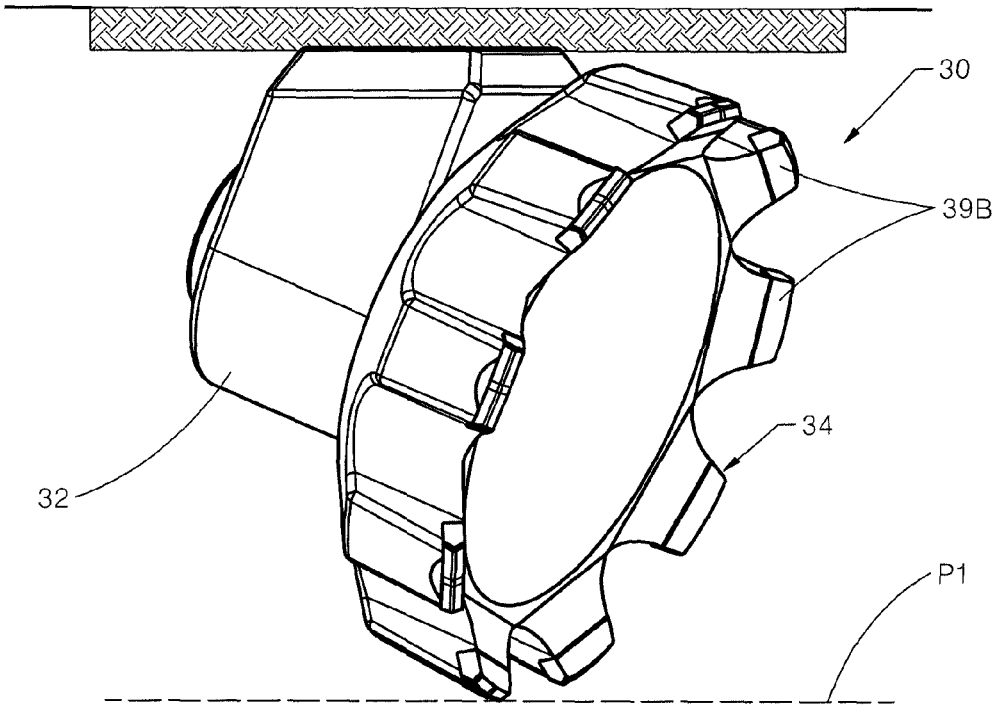

In the embodiments illustrated in FIGS. 2-12, the cutting elements are depicted as being formed from a single material, one particular alloy steel being a steel with about 12 percent vanadium, about 3.25 percent carbon, and lesser amounts of chrome and molybdenum. And of course there are a multitude of other types of high strength wear resistant materials. In such embodiments, the cutting elements can be manufactured from many materials of high yield strength and wear resistance, such as suitable metals including wear resistant steel alloys. Alternatively, the cutting elements 30 may include inserts that form the outer working edge 38 of the cutting elements. For example, as shown in FIGS. 13A and 13B, each of the teeth 34 may include a cavity to hold an insert 39(A) or 39(B), respectively, made of a highly wear resistant material, such as a carbide or diamond tipped material. An example of a suitable material is tungsten carbide (e.g., 90% tungsten and 10% cobalt). In certain applications, the use of such inserts 39(A) or 39 (B) can extend the life of the cutting elements 30 considerably. FIG. 13A illustrates the cutting element 30 with a sharp ending insert 39(A) for relatively softer material compared to the blunt ending insert 39(B) in FIG. 13B. A blunt ending is best suited for the cutting of extremely hard materials.

Just as the configuration and spacing of the cutting elements 30 on the driven transport device can be variable, the diameter of the cutting elements can also be varied. For example, the cutting elements can range in size from several inches in diameter to less than an inch in diameter. The selection of diameter can depend on the particular driven transport device and the particular application for which the cutting elements are being applied. These variations are possible regardless of whether the transport device is a chain, as shown in the drawings, or if the cutting elements are mounted on a rotating shaft or tube.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A universal cutter assembly comprising:

two or more freewheeling cutting elements mounted to a rotating chain or tube, each element having a cutting face and being freely rotatable about an axis so that the rotating chain or tube imparts on the cutting element a rolling engagement of the cutting face with a surface to be cut, wherein respective axes of at least a pair of opposing cutting elements cross in an area between the rotating chain or tube and the surface being cut; and a mount securing each of the freewheeling cutting elements to the rotating chain or tube so as to orient the axis and corresponding cutting face at (a) a tilt angle β with respect to a plane of the surface to be cut, and (b) a side angle α with respect to a direction of movement of the rotating chain or tube, thereby causing discrete teeth distributed about an outer working edge of the cutting face to roll both laterally and vertically in a rotational manner with respect to the direction of movement and the surface to be cut.

2. The universal cutter assembly recited in claim 1, wherein the cutting face of one or more of the cutting elements is concave.

3. The universal cutter assembly recited in claim 1, wherein the tilt angle β is in a range of approximately 7.5° to 30°.

4. The universal cutter assembly recited in claim 1, wherein the side angle α is in a range of approximately 7.5° to 30°.

5. The universal cutter assembly recited in claim 1. wherein the two or more cutting elements are laterally offset from each other in the direction of movement so that the cutting elements create a wider kerf than a kerf created by each individual cutting element.

6. The universal cutter assembly recited in claim 1, wherein the outer working edge of the cutting element has a generally circular shape.

7. The universal cutter assembly recited in claim 1, wherein the outer working edge of the cutting element has a generally circular shape.

8. The universal cutter assembly recited in claim 1, wherein the cutting elements are mounted to the rotating chain that includes a plurality of links, and wherein a plurality of the freewheeling cutting elements are mounted on at least one of the links of the chain.

9. The universal cutter assembly recited in claim 1, wherein the discrete teeth of the cutting face rotate at a distance about the axis of rotation.

10. The universal cutter assembly recited in claim 1, wherein the lateral and rotationally vertical movement of the discrete teeth exert a tensile force on the surface to be cut.

11. The universal cutter assembly recited in claim 7, wherein the discrete teeth of each of the cutting elements project axially with respect to the axis of rotation of the cutting element as well as radially with respect to the generally circular shape of the cutting face.

12. A method of cutting a surface using a cutter assembly having a cutting element whose cutting face is positioned at a tilt angle β with respect to a plane of the surface and at a side angle α with respect to a direction of travel, wherein the method comprises:

moving the cutter assembly into cutting engagement with a surface to be cut while moving the cutter assembly in the direction of travel, causing rotation of the cutting element of the cutter assembly about an axis of rotation when an outer working edge of the cutting element comprising carbide teeth contacts the surface to be cut, wherein the carbide teeth of the cutting element rotate at a distance about the axis;

moving the carbide teeth both laterally and vertically in a rotational manner with respect to the direction of travel and the surface to be cut as a result of the tilt and side angles β and α, respectively, in response to the movement of the cutter assembly and the rotation of the cutting element;

exerting a tensile force on the surface to be cut as a result of the lateral and rotationally vertical movement of the carbide teeth; and cutting the surface in response to the exerted force.

13. The method of cutting a surface in claim 12, wherein the cutting face of the cutting element is concave.

14. The method of cutting a surface in claim 12, wherein the tilt angle β is in a range of approximately 7.5° to 30°.

15. The method of cutting a surface in claim 12, wherein the side angle α is in a range of approximately 7.5° to 30°.

16. The method of cutting a surface in claim 12, including laterally offsetting cutting elements from each other so that the cutting elements cooperate to create a wider kerf than a width of a kerf created by each individual cutting element.

17. The method of cutting a surface in claim 12, wherein the carbide teeth spaced are spaced around a circumference of the cutting element.

18. The method of cutting a surface in claim 17, wherein the carbide teeth of the cutting element project radially outwardly as well as in an axial direction from the cutting face of the cutting element.

19. A cutter assembly comprising:

a cutting element for engaging material to be cut;

a cutting face of the cutting element that includes a working periphery of discrete teeth forming a generally closed circular shape for rolling engagement with the material;

a mount supporting the cutting element and the cutting face on a rotating chain or tube for freewheeling rotation of the cutting element and cutting face about an axis of rotation that cants the cutting face at (a) a tilt angle β with respect to a surface of the material to be cut and (b) an angle α with respect to a direction of travel of the transport device such that the rolling engagement of the cutting face with the material causes the teeth engaging the material to move laterally with respect to the direction of travel and upwardly with respect to the surface of the material; and each of the teeth configured to create a tensile force on the material it engages, causing the material to break apart.

20. The cutter assembly of claim 19, wherein the discrete teeth spaced around the periphery and projecting radially outwardly.

21. The cutter assembly of claim 20, wherein the cutting element is among a plurality of cutting elements laterally offset from each other in the direction of travel of the transport device.

* * * * *